US005798024A

United States Patent [19]

Odell et al.

[11] Patent Number: 5,798,024

[45] Date of Patent: Aug. 25, 1998

[54] CONTROLLING WEB ANISTROPY IN A ROLL AND BLADE TWIN-WIRE GAP FORMER

[75] Inventors: Michael Odell; Lauri Verkasalo, both of Jyväskylä, Finland

[73] Assignee: Valmet Corporation, Helsinki, Finland

[21] Appl. No.: 661,657

[22] Filed: Jun. 11, 1996

[51] Int. Cl.[6] ..... D21F 1/00

[52] U.S. Cl. ..... 162/203; 162/198; 162/300; 162/301

[58] Field of Search ..... 162/300, 301, 162/203, 343, 252, 259, 198

[56] References Cited

U.S. PATENT DOCUMENTS

| | | | |
|---|---|---|---|
| 3,843,470 | 10/1974 | Betley et al. | 162/343 |
| 3,923,593 | 12/1975 | Verseput | 162/343 |
| 5,034,098 | 7/1991 | Hergert | 162/301 |
| 5,129,988 | 7/1992 | Farrington, Jr. | 162/203 |
| 5,167,770 | 12/1992 | Bubik et al. | 162/301 |
| 5,215,628 | 6/1993 | Koivuranta et al. | 162/301 |
| 5,393,378 | 2/1995 | Yakabe et al. | 162/259 |
| 5,552,021 | 9/1996 | Ilvespaa et al. | 162/301 |
| 5,599,427 | 2/1997 | Koivuranta et al. | 162/301 |

*Primary Examiner*—Karen M. Hastings
*Attorney, Agent, or Firm*—Steinberg & Raskin, P.C.

[57] ABSTRACT

A roll and blade gap former for a paper machine having first and second wires guided in a respective loop and defining a twin-wire forming zone, a forming gap in which the first and second wires converge before the twin-wire zone, a headbox including a slice channel having a slice opening through which a stock suspension jet is fed into the forming gap to form a web between the wires, and drainage and forming elements arranged in the twin-wire zone for removing water from the web. To provide an improvement in the control of the Z-direction properties of the web, the former includes turbulence generating vanes arranged in the slice channel in the headbox to cause turbulence in the stock suspension jet upon its discharge from the slice opening into the forming gap and a first forming roll arranged in the twin-wire zone and which constitutes the first drainage and forming elements in the twin-wire zone after the forming gap. A run of the twin-wire zone after the forming gap is curved over a wrap angle sector of the first forming roll which is less than about 25°. The forming and draining elements produce a pulsating pressure effect on the web after the curved run of the twin-wire zone over the wrap angle sector of the first forming roll. A method for controlling the anisotropy of web formed in a roll and blade former is also described.

20 Claims, 17 Drawing Sheets

10
11
1 SURFACE MOUNTED PRESSURE TRANSDUCER
D
J
G
a
22
21'
2 PRESSURE TRANSDUCER BETWEEN FABRICS
20

PRESSURE
+ve
INITIAL ZONE
CONSTANT ZONE
VACUUM ZONE
T/R
0
LOW ANGLE
HIGH ANGLE
-ve
WRAP ANGLE
IP IMPINGEMENT POINT

FIG. 13A
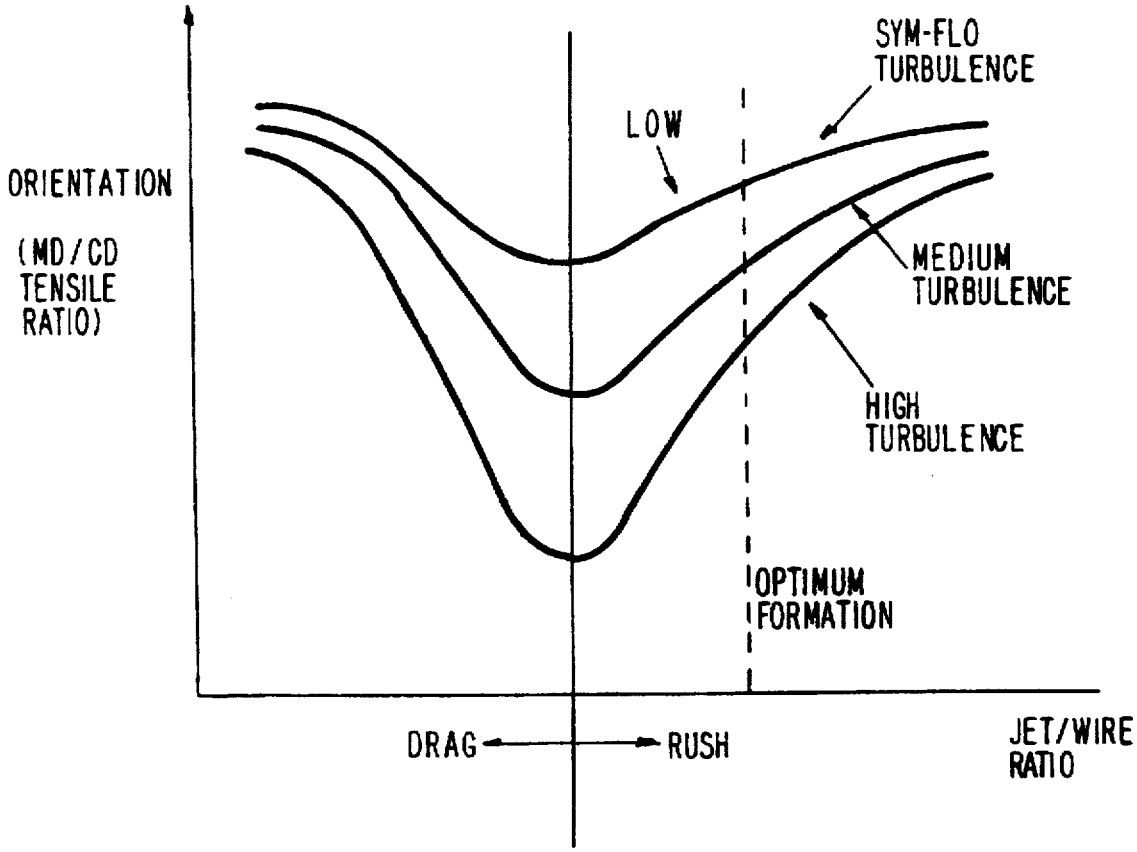
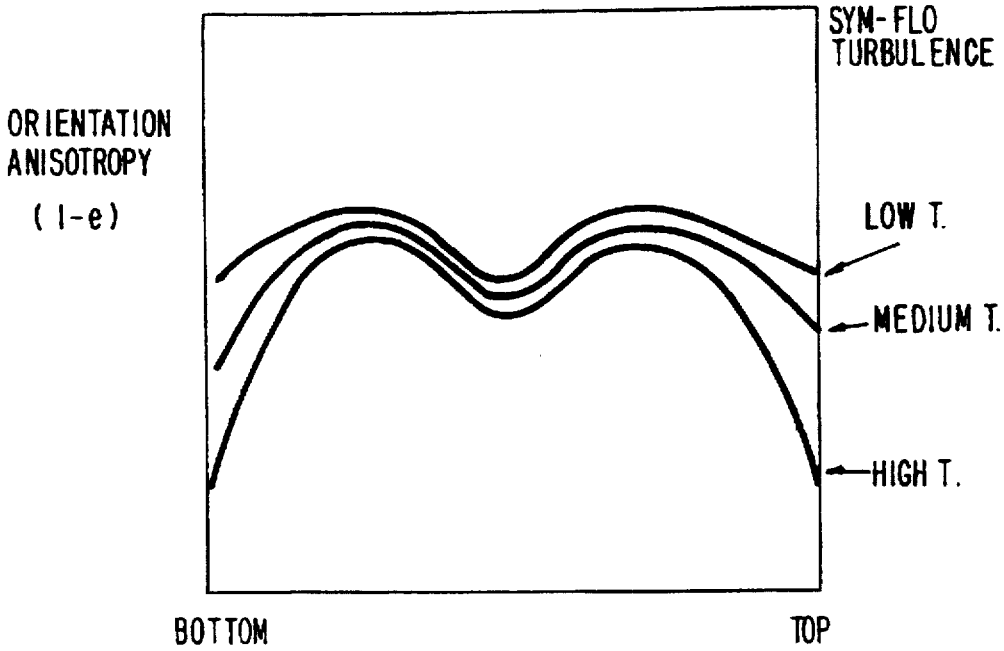
FIG. 13B

FIG. 15A
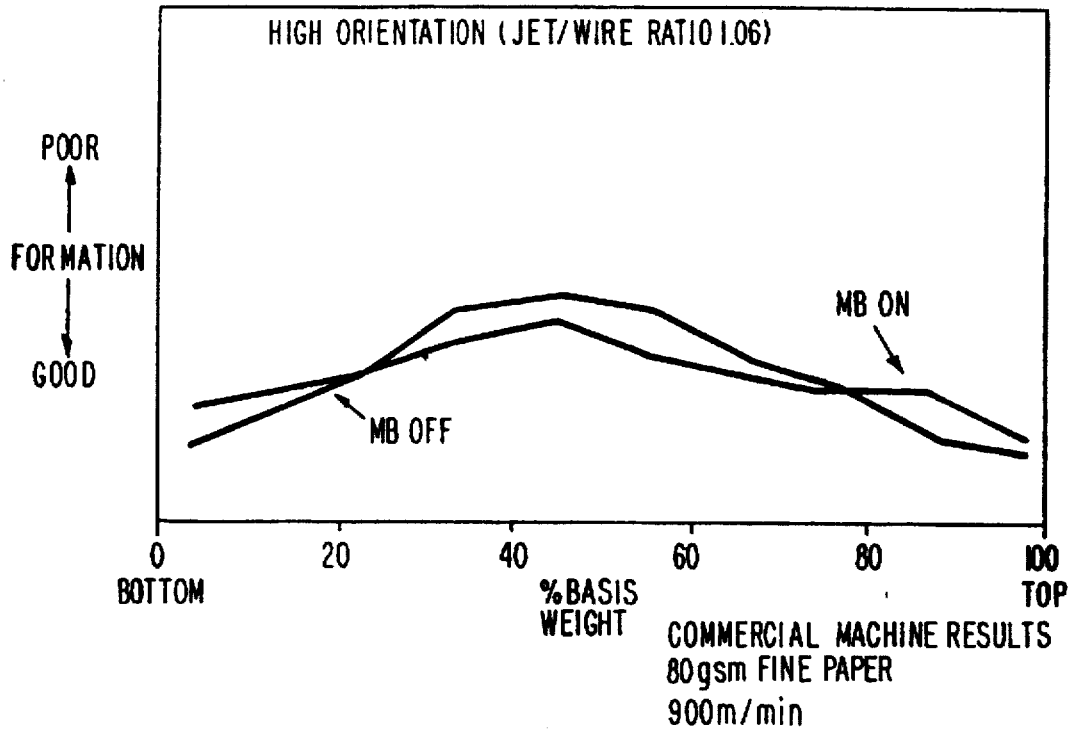
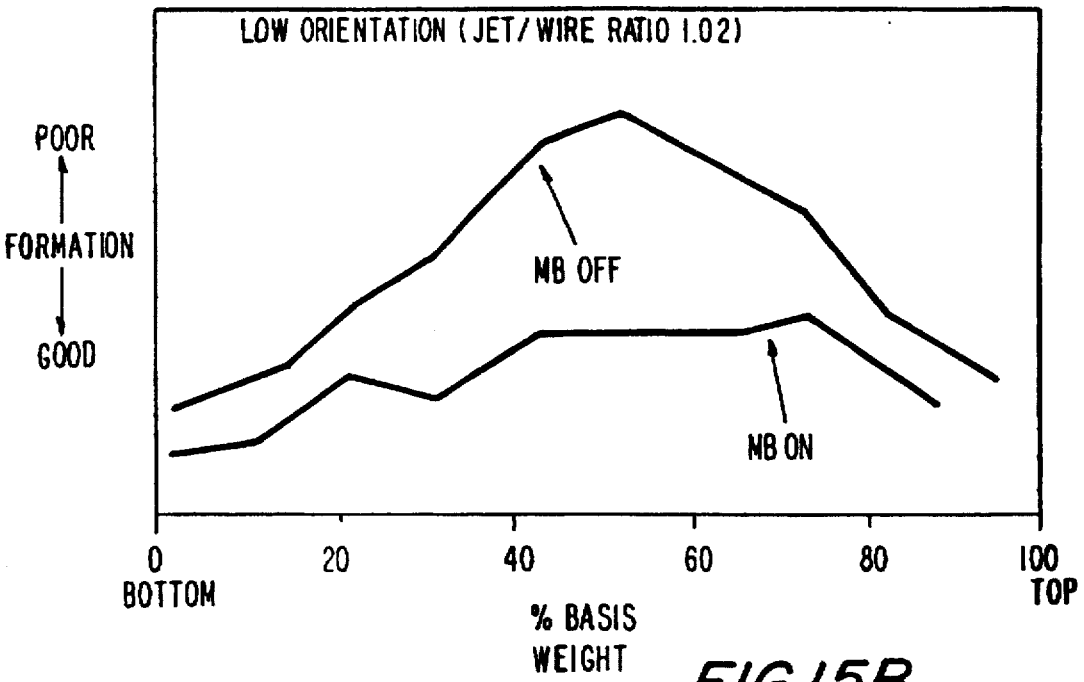
FIG. 15B
COMMERCIAL MACHINE RESULTS
80gsm FINE PAPER
900m/min

CONTROLLING WEB ANISTROPY IN A ROLL AND BLADE TWIN-WIRE GAP FORMER

FIELD OF THE INVENTION

The present invention relates to a roll and blade gap former for a paper machine, in particular for manufacturing fine paper, which comprises a pair of forming wire and a headbox which feeds a stock suspension jet into a forming gap defined by a convergence of the forming wires so as to form a paper web which is then carried by the forming wires in a twin-wire zone. One of the forming wires is a covering wire which is guided by an associated set of guide rolls while the other forming wire is a carrying wire which is guided by an associated set of guide rolls. The paper web follows the carrying wire after the twin-wire zone formed by the wires. In the twin-wire zone, there are drainage and web-forming elements which remove water from the web.

Background of the Invention

Roll and blade forming was originally introduced for newsprint in 1987 as a means for producing formation quality similar to that of a blade former but without the accompanying problems of low retention and sensitive operation associated with the use of a blade former. The original newsprint former configuration has been progressively developed since 1987 and this forming technique has also been adapted to make all other printing and writing paper grades.

The symmetric Z-direction orientation structure of a web produced by roll and blade formers gives much better control of the curling tendency of the web than other types of formers. Roll and blade formed paper is virtually free from structural curl (orientation two-sideness) over a wide range of jet-to-wire ratios. This characteristic comes from the symmetry of drainage and shear over the forming roll. Roll and blade formers can, therefore, be optimized for formation, orientation, and misalignment angle profile without comprising curl tendency.

OBJECTS AND SUMMARY OF THE INVENTION

An object of the present invention is to provide a novel former, in particular for manufacturing fine paper.

It is another object of the present invention to provide a new and improved former by whose means good formation of paper together with a tensile ratio of MD/CD as low as 1.5:1 can be accomplished.

Another object of the present invention is further development of prior art roll and blade gap formers in which a forming shoe and/or an MB-blade unit or units is/are employed in the twin-wire zone. In the following, the general designation "ROLL and BLADE" formers will be used for these formers.

It is another object of the invention to provide a new and improved method for producing a paper web or fibrous web in which by controlling certain web formation parameters, it is possible to provide the web with a relatively even distribution of fiber orientation.

In view of achieving the objects stated above and others, the former in accordance with the invention comprises a combination of:

a) a headbox having a slice channel provided with turbulence generating vanes so that a stock suspension jet discharged from a slice opening of the slice channel into a forming gap, which is defined by a convergence of first and second wires, has an adequate turbulence level;

b) a first forming roll which is the first drainage and forming element in a twin-wire zone following the forming gap and defined by the first and second wires, and which defines in part the forming gap, the diameter $D_1$ of the first forming roll being dimensioned in the range of $D_1 \geqq$ about 1.4 m;

c) the twin-wire zone curves directly after the forming gap about the first forming roll over a wrap angle sector of the first forming roll having a wrap angle a which is less than about 25°; and d) at least one forming member is arranged substantially directly after the wrap angle sector or after a relatively short twin-wire run after the wrap angle sector and includes forming blades which produce a pulsating pressure effect on the paper web that is being drained between the forming wires.

By means of a combination of the four different characteristic features mentioned above, evident combination effects and mutual synergy are achieved, as will come out in more detail below.

The first forming roll may comprises a roll mantle having through perforations leading from an exterior of the roll mantle to an interior of the roll mantle and means defining a suction chamber in the interior in the wrap angle sector such that the through perforations are communicable with the suction chamber. The former may additionally comprise a first forming shoe arranged in the twin-wire zone after the first forming roll and including a linear and/or curved blade deck, and an MB-unit arranged in the twin-wire zone after the first forming shoe and including at least one support member arranged inside a loop of the first wire and at least one drainage and loading member arranged in the loop of the second wire in opposed relationship to the support member (s) in the loop of the first wire. The support member(s) and drainage and loading member(s) comprise blades and define a twin-wire blade zone therebetween. A second forming shoe may be arranged in the twin-wire zone after the MB-unit, and a second forming roll may be arranged in the twin-wire zone after the second forming shoe. The first wire is separated from the web after or in conjunction with the second forming roll whereby the web follows the first wire.

In one embodiment of the method in accordance with the invention, the anisotropy of a web formed in a roll and blade gap former is controlled by generating turbulence in a stock suspension jet in a slice channel of a headbox, discharging the stock suspension jet at a first speed from a slice opening of the slice channel of the headbox and directing the stock suspension jet into a forming gap defined in part by a first forming roll having a diameter greater than or equal to about 1.4 m. The stock suspension jet is directed into a convergence of first and second wires which define a twin-wire zone after the forming gap and the first forming roll is arranged in a loop of the first or second wire. Further, a run of the twin-wire zone is directed after the forming gap in a curve over a wrap angle sector of the first forming roll having a magnitude less than about 25°, a pulsating pressure effect is produced on the web after the curved run of the twin-wire zone over the wrap angle of the first forming roll and the first and second wires are guided to run at a second speed. The first speed of the stock suspension jet is controlled relative to the second speed of the first and second wires to thereby define a jet-to-wire ratio which constitutes the ratio of the second speed to the first speed. At least one, and possibly all, of the diameter of the first forming roll, the wrap angle sector of the first forming roll, a magnitude of the pulsating pressure effect and an amount of turbulence in the stock suspension jet are controlled, regulated or set relative to the jet-to-wire ratio to provide for an optimum anisotropy in the web.

In one particular embodiment, to produce the pressure pulsating effect, a first forming member having stationary forming blades is arranged in a loop of the first wire, a second forming member having loadable forming blades is arranged in a loop of the second wire such that the blades in the second forming member alternate with the blades in the first forming member in a running direction of the web, and a pressure impulse applied to the blades in the second forming member is regulated to vary the loading of the blades in the second forming member in order to provide an adjustable drainage and formation effect. In addition, a vacuum can be applied through gap spaces defined between the blades in the first and/or second forming members to intensify the drainage of water through the gap spaces.

In another embodiment of the method in accordance with the invention, turbulence is generated in a stock suspension jet in a slice channel of a headbox, the stock suspension jet is discharged from a slice opening of the slice channel of the headbox and directed into a forming gap defined in part by a first forming roll having a diameter greater than or equal to about 1.4 m. More particularly, the stock suspension jet is directed into a convergence of first and second wires which define a twin-wire zone after the forming gap while the first forming roll is arranged in a loop of the first or second wire. A run of the twin-wire zone is directed after the forming gap in a curve over a wrap angle sector of the first forming roll having a magnitude less than about 25° and a pulsating pressure effect is produced on the web after the curved run of the twin-wire zone over the wrap angle of the first forming roll. Lastly, the diameter of the first forming roll, the wrap angle sector of the first forming roll, a magnitude of the pulsating pressure effect and/or an amount of turbulence in the stock suspension jet is/are determined relative to one another to provide for an optimum anisotropy in the web.

In the following, the invention will be described in detail with reference to some exemplifying embodiments of the invention illustrated in the figures in the accompanying drawing. However, the invention is not confined to the details of these exemplifying embodiments.

BRIEF DESCRIPTION OF THE DRAWINGS

The following drawings are illustrative of embodiments of the invention and are not meant to limit the scope of the invention as encompassed by the claims .

FIG. 13A is a graphic illustration of the control of fiber orientation in the paper web with different headbox types.

FIG. 13B is a graphic illustration of the orientation anisotropy in the paper web with different headbox types.

FIGS. 15A and 15B are graphic illustrations of the control of layered formation of the web by means of a MB-unit

DETAILED DESCRIPTION OF THE INVENTION

Figure 1:
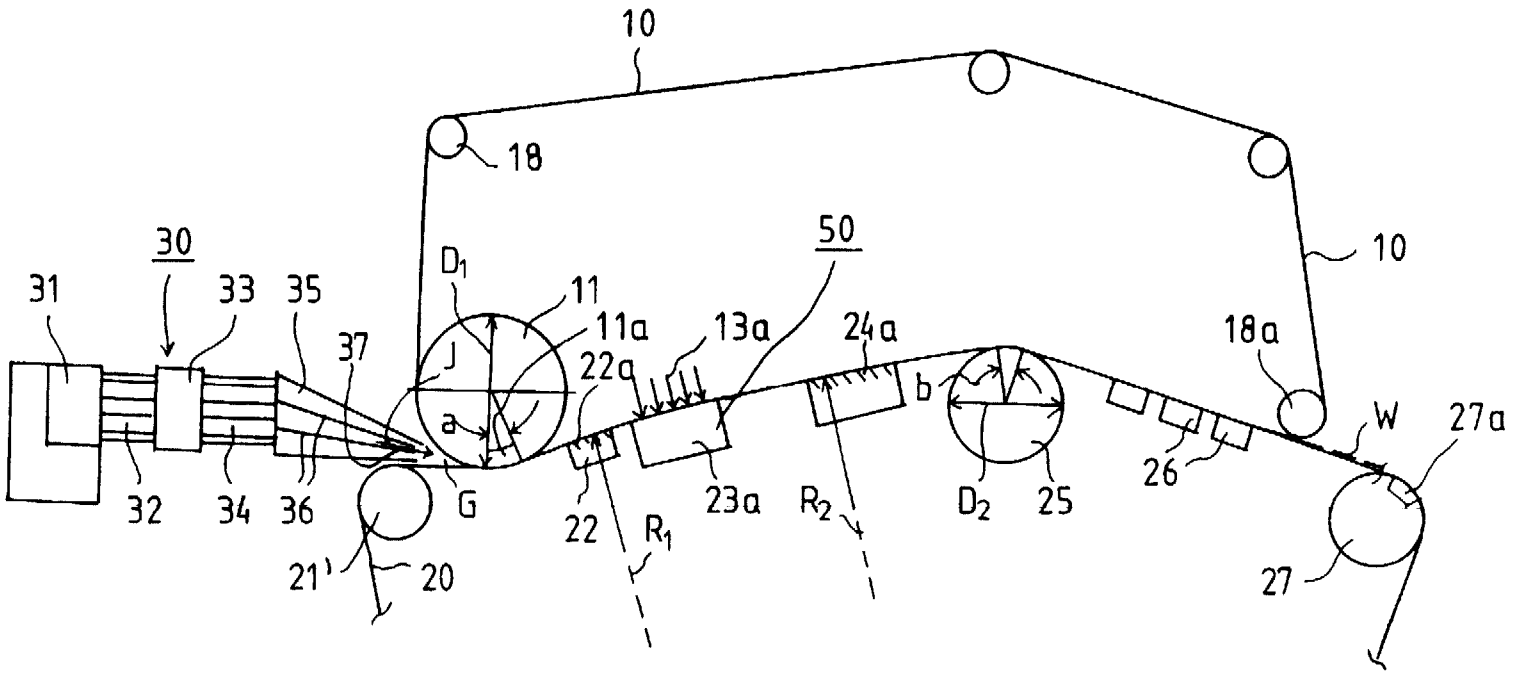
FIG. 1 is a schematic side view of a roll and blade gap former in accordance with the present invention in which the first forming roll is arranged inside the loop of the upper wire and the principal running direction of the twin-wire zone is substantially horizontal.

Referring to the accompanying drawings wherein the same reference numerals refer to the same or similar elements, reference is first made to the embodiments illustrated in FIGS. 1–4D which are horizontal versions of the twin-wire former in accordance with the invention. As shown in FIGS. 1–4D, the former in accordance with the invention comprises a lower wire 20 guided in a loop by guide rolls. The lower wire 20 is called the "carrying wire" because the web W follows this wire after the twin-wire zone. The former also comprises an upper wire 10 guided in a loop by rolls 18, 18*a*. The upper wire 10 is called the "covering wire" and, together with the lower wire 20, it defines a twin-wire zone whose principal running direction is substantially horizontal in the embodiments shown in FIGS. 1–4D. In the twin-wire zone, the drainage of water from the paper web W that is being formed takes place through both wires 10, 20. After the twin-wire zone, the paper web W follows the lower wire 20 over a suction zone 27*a* of a wire suction roll 27 to a pick-up point to be passed onward, e.g., into a press section (not shown).

The former includes a headbox 30 having a slice opening 37 from which a stock suspension jet J is fed into a wedge-shaped forming gap G defined by a convergence of the wires 10, 20. The headbox 30, which is shown schematically, may comprise, in the direction of flow of the stock suspension, an inlet header 31, a first bank of tubes such as a distributor manifold 32, an equalizing chamber 33, a second bank of tubes such as a set of turbulence tubes 34 and a narrowing slice channel 35 out of whose slice opening 37 the stock suspension jet J is discharged into the forming gap G. It is an important feature of the former in accordance with the present invention that the headbox 30 that is used to expressly what is called headbox with vanes, i.e., in the slice channel 35, there are a number of turbulence vanes or turbulence generating vanes 36, arranged one above the other. The turbulence vanes 36 may be in the form of thin flexible plates and are fixed at an end next to the set of turbulence tubes 34 or plates so as to be freely floating and positioned in the stock suspension flow at their opposite end proximate the slice opening 37. By means of the turbulence vanes 36, a particularly high level of microturbulence and a high-energy turbulence state are produced in the stock suspension jet J discharged out of the slice opening 37, which has synergic effects with other specific features of the invention, which will be described later. It is also foreseen that other headboxes may be used in the invention capable of generating a controllable degree of turbulence in the stock suspension being discharged from the headbox.

In the horizontal former arrangement shown in FIG. 1, the forming gap G is defined from above by the first forming roll 11, which is arranged inside the loop of the upper wire 10 and which is provided with a suction zone 11*a*. The first forming roll 11 is arranged inside the loop of the upper wire 10 in FIG. 1, whereas in FIGS. 2 and 3, the corresponding forming roll 21, which is provided with a similar suction zone 21*a*, is arranged inside the loop of the lower wire 20. The formers shown in FIGS. 2 and 3 differ from the former shown in FIG. 1 also in the respect that in the embodiments shown in FIGS. 2 and 3, the run of the twin-wire zone is horizontal immediately after the first forming roll 21, whereas in FIG. 1, the twin-wire zone is upwardly rising at an angle of about 20°. On the forming roll 11, the run of the twin-wire zone is curved on a wrap angle sector a in FIGS. 1 and 4A in an up ward direction and in FIGS. 2 and 3 in a downward direction (depending on the location of the forming roll 11,21). After the wrap angle sector a, in FIGS. 1 and 4A, there follows an upwardly inclined run of the twin-wire zone, in which, inside the loop of the lower wire 20, there is first a forming shoe 22 provided with a curved blade deck 22*a* and after that an MB-unit 50. The MB-unit 50 comprises drainage elements 13*a* and 23*a* arranged in an opposed relationship with the twin-wire zone running therebetween. Drainage element 13*a* includes fixed support blades or ribs and drainage element 23*a* includes movable support blades or ribs which are operatively loaded toward the fixed support blades by loading means to effect dewatering of the web. Other facets of the MB-unit 50 are discussed below. The MB-unit 50 is followed, inside the loop of the lower wire 20, by a second forming shoe 24 provided with a curved blade deck 24*a*. The curve radius $R_1$ of the first forming shoe 22 is typically selected to be from about 2 m to about 8 m and the curve radius $R_2$ of the second forming shoe 24 is also typically selected to be from about 2 m to about 8 m.

Figure 2:
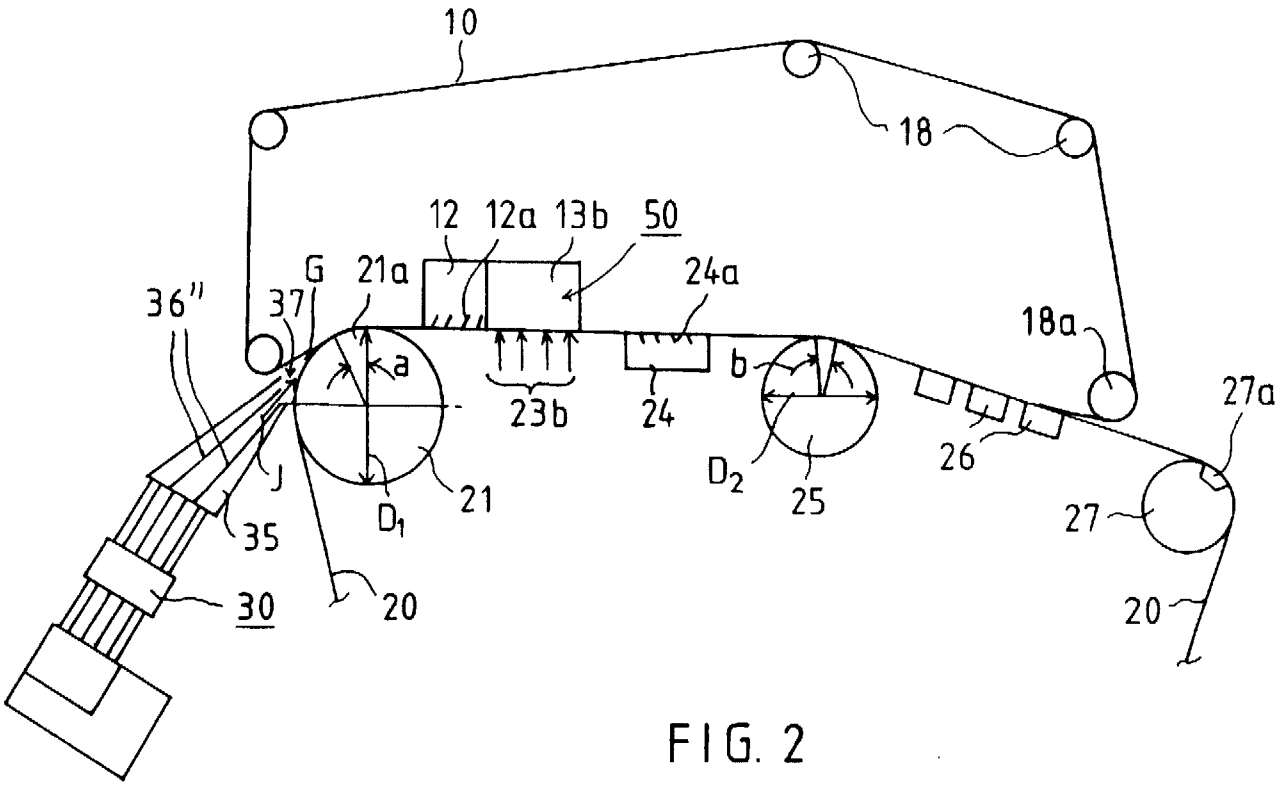
FIG. 2 is a schematic view of another embodiment of a former in accordance with the invention in which the first forming roll is arranged inside the loop of the lower wire.
Figure 3:
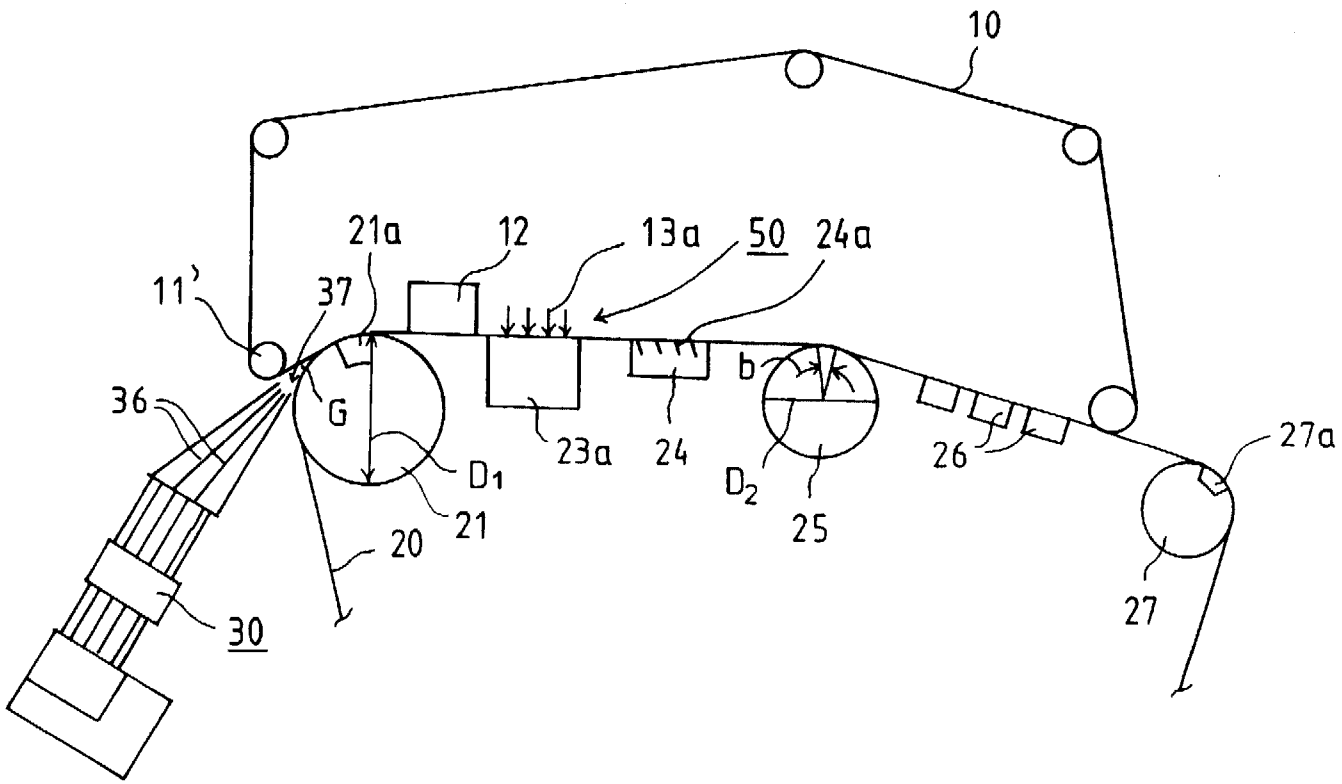
FIG. 3 is a schematic view of another embodiment of the former in accordance with the invention in which the support and loading blades in the MB-unit following after the first forming roll in the twin-wire zone are arranged in inverted positions in relation to the embodiment shown in FIG. 2.

As shown in FIGS. 1, 2, 3, 4A and 4B, the principal direction of the run of an adjustably loadable MB-blade zone defined between the first and the second forming shoes 22 and 24, and in which elements in the MB-unit are operative against an adjacent wire, is substantially linear. In FIG. 4C, the principal direction of the run of the MB-blade zone between the first and second forming shoes 22 and 24 is downwardly curved with a curve radius $R_a$, and in FIG. 4D, it is upwardly curved with a curve radius $R_b$. According to the embodiments shown in FIGS. 1–3, after the second forming shoe 24, there follows a second forming roll 25 arranged inside the loop of the lower wire 20, in the area of which roll the twin-wire zone is curved downwardly on the sector b. The magnitude of the sector b is typically selected in the range of from about 10° to about 40°. The second forming roll 25 is a roll which is preferably provided with a solid smooth mantle and has a diameter $D_2$ typically selected in the range from about 0.8 m to about 1.5 m depending on the machine width. As shown in FIGS. 1–3, on the downwardly inclined run of the twin-wire zone after the second forming roll 25, there are flat suction boxes 26, after which the upper wire 10 is separated from the lower wire 20 about the guide roll 18*a*, and the web W then follows the lower wire 20 to the pick-up point.

The formers illustrated in FIGS. 2 and 3 are in most respects similar to one another with the exception of the relative positioning of drainage elements 13*a*, 13*b* and 23*a*, 23*b* in the MB-unit 50. In FIG. 2, the drainage element 13*b* of the MB-unit is arranged inside the loop of the upper wire 10 and comprises stationary support blades 13L which guide the twin-wire zone and which are seen more clearly in FIGS. 4B, 4C and 4D. In FIG. 2, the drainage element 23*b* of the MB-unit 50 is arranged inside the loop of the lower wire 20 and comprises flexible loading blades 23L which are loadable by loading means (not shown) with an adjustable force F and which are also seen more clearly in FIGS. 4B, 4C and 4D. The loading forces F of the loading blades 23L are produced in a manner in itself known by passing a medium of adjustable pressure, such as air or water, into loading hoses (not shown), which load the loading blades 23L against the wires 10,20 and against the stationary support blades 13L. The stationary support blades 13L are arranged in an alternating relationship with the flexible loading blades 23L as shown in FIGS. 4B, 4C and 4D. In FIG. 3, the corresponding drainage elements 13*a* and 23*a* of the MB-unit are arranged in positions opposite in relation to the corresponding elements 13*b* and 23*b* shown in FIG. 2. In FIGS. 2 and 3, the MB-unit 50 is preceded by a drainage unit 12, for example a suction deflector unit provided with a deflector blade or with a set of deflector blades 12*a*, which unit is in itself known. In FIGS. 2 and 3, the MB-unit 50 is followed in the twin-wire zone by a flat suction box 24, in which there is a stationary set of deck blades 24*a* arranged in one plane to provide a straight run of the twin-wire zone or curved to provide a curved run of the twin-wire zone.

Figure 4A:
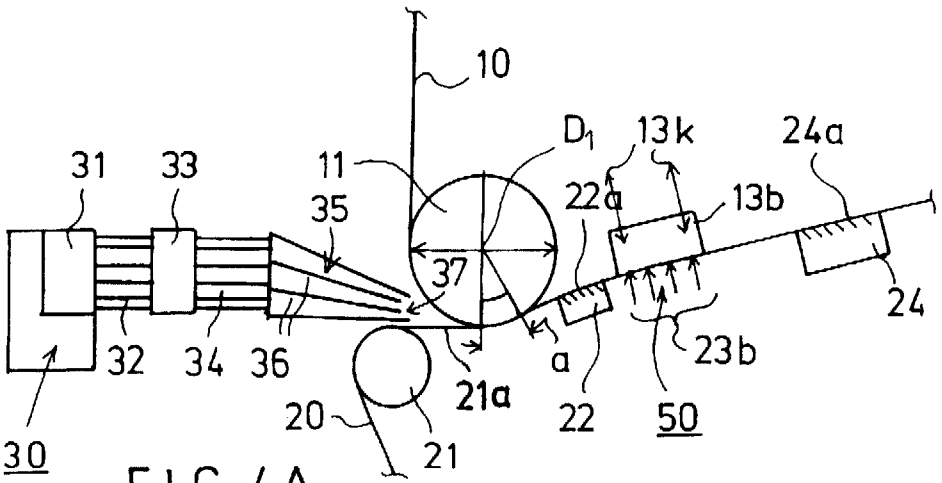
FIG. 4A is a view of a preferred embodiment of the initial part of the twin-wire zone in a former whose overall embodiment is substantially similar to the former shown in FIG. 1, wherein important elements and features of the former in accordance with the invention are in use.
Figure 4B:
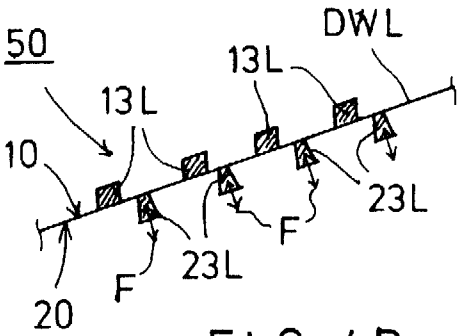
FIG. 4B shows a first embodiment of the twin-wire zone following after the first forming roll.
Figure 4C:
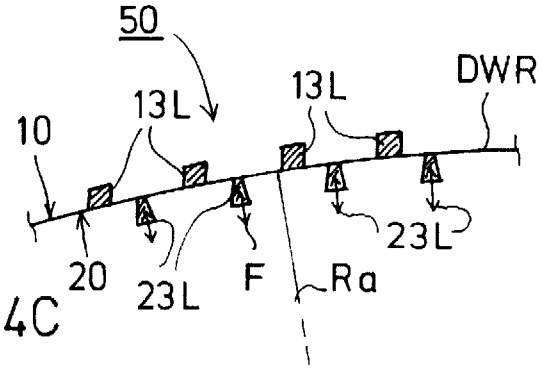
FIG. 4C is an illustration similar to FIG. 4B of a second embodiment of the twin-wire zone.
Figure 4D:
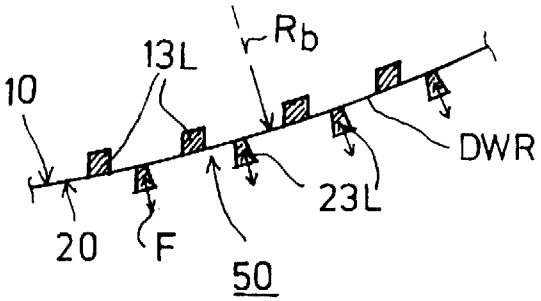
FIG. 4D is an illustration similar to FIGS. 4B and 4C of a third embodiment of the twin-wire zone.

FIG. 4A shows an MB-unit in which the element 13*b* arranged inside the loop of the upper wire 10 comprises schematically illustrated position adjustment means such as position adjustment controls 13K, which are arranged in connection with the front and rear edges of the element 13*b* and by whose means the position and the loading of the element 13*b* in relation to the loading blades 23L (FIGS. 4C and 4D) of the element 23*b* arranged inside the loop of the lower wire 20 can be adjusted.

According to FIG. 4B, in the area of the sets of blades that guide and load the twin-wire zone in the MB-unit 50, the run of the twin-wire zone DWL is linear and upwardly inclined. In the MB-unit 50, the blades 13L arranged inside the loop of the upper wire 10 are stationary support blades, and the blades 23L arranged inside the loop of the lower wire 20 are flexible blades which can be loaded with adjustable forces F produced by means of a pressure medium. By means of the blades 13L,23L, in the twin-wire zone DWL, the pressure impulse of the set of blades and the formation and the drainage effect can be regulated. If necessary, the environment of the elements 13*b*, 23*b* (FIG. 4A) may be connected with sources of vacuum which intensify the drainage of water through the gap spaces between the sets of blades 13L and 23L.

The construction of the set of blades in the MB-unit 50 shown in FIG. 4C is in most respects similar to that shown in FIG. 4B, except that in the area of the set of blades 13L, 23L, the run of the twin-wire zone DWR is downwardly curved while the center of the curve radius $R_a$ is arranged at the side of the loop of the lower wire 20. The run of the twin-wire zone DWR shown in FIG. 4D is in other respects similar to that shown in FIG. 4C, except that the center of the curve radius $R_b$ of the twin-wire zone DWR is arranged at the side of the loop of the upper wire 10.

FIG. 4A shows a former in accordance with the invention including the unique combination of four particular characteristic features of the present invention, which particular features have a mutual combined effect and synergy, as stated above and which is described in more detail later, in particular with reference to FIGS. 9A–16. As stated above, the first specific feature of the invention is the use of the turbulence vanes 36 in the slice channel 35 of the headbox 30 to cause the turbulence level in the stock suspension jet J discharged out of the slice opening 37 to be elevated and sufficiently high, i.e., above a situation in which turbulence vanes 36 are not used in a conventional headbox. It is a second specific feature of the invention that the extent of the wrap angle a on the first forming roll 11,21 which follows directly after the forming gap G has been set to be less than or equal to about 25°, preferably a is only from about 10° to about 20°. It is a third specific feature of the invention that the diameter $D_1$ of the first forming roll 11,21 is dimensioned to be greater than or equal to about 1.4 m, preferably $D_1$ is from about 1.5 m to about 1.8 m. A fourth specific feature of the invention is the use of the MB-unit 50 so that the twin-wire zone runs through the gap between the sets of blades 13L, 23L, one of which is loaded with adjustable forces F against the other, either along a linear path (FIG. 4B), along a downwardly curved path (FIG. 4C), or along an upwardly curved path (FIG. 4D). At this juncture, it is noted that with a wrap angle less than or equal to about 25° and a diameter of the forming roll about which the wrap angle is defined being greater than or equal to about 1.4 m (in the specific press section combination), the advantageous benefits attained in accordance with the invention are more pronounced and prominent.

FIGS. 5–8 illustrate vertical versions of the twin-wire former in accordance with the invention, wherein the run of the twin-wire zone is vertical and proceeds from the bottom towards the top, i.e., the forming gap is defined in a lowermost vertical position.

Figure 5:
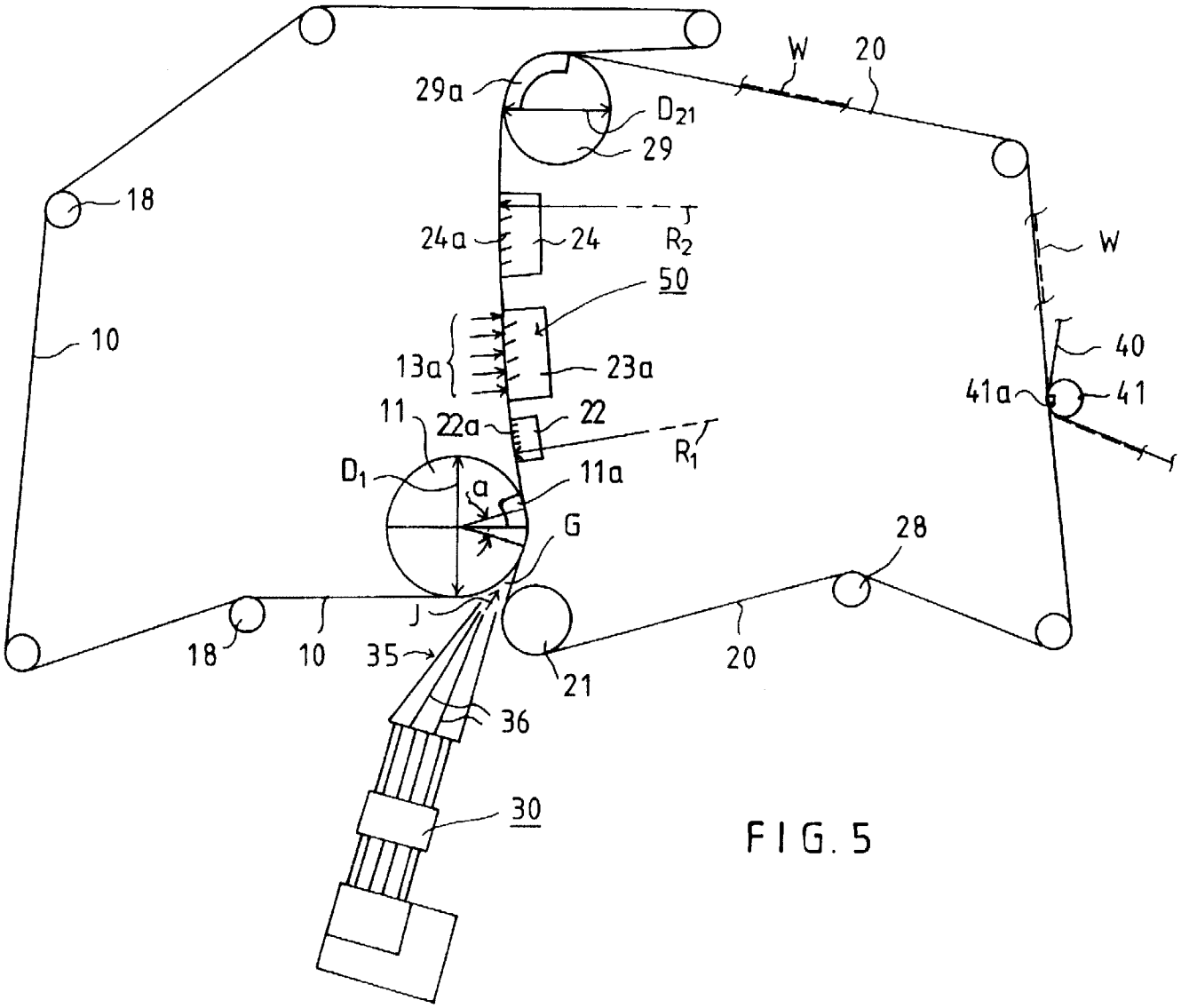
FIG. 5 is a schematic view of an embodiment of the roll and blade gap former in accordance with the invention in which the principal direction of the twin-wire zone is vertically upward.
Figure 6:
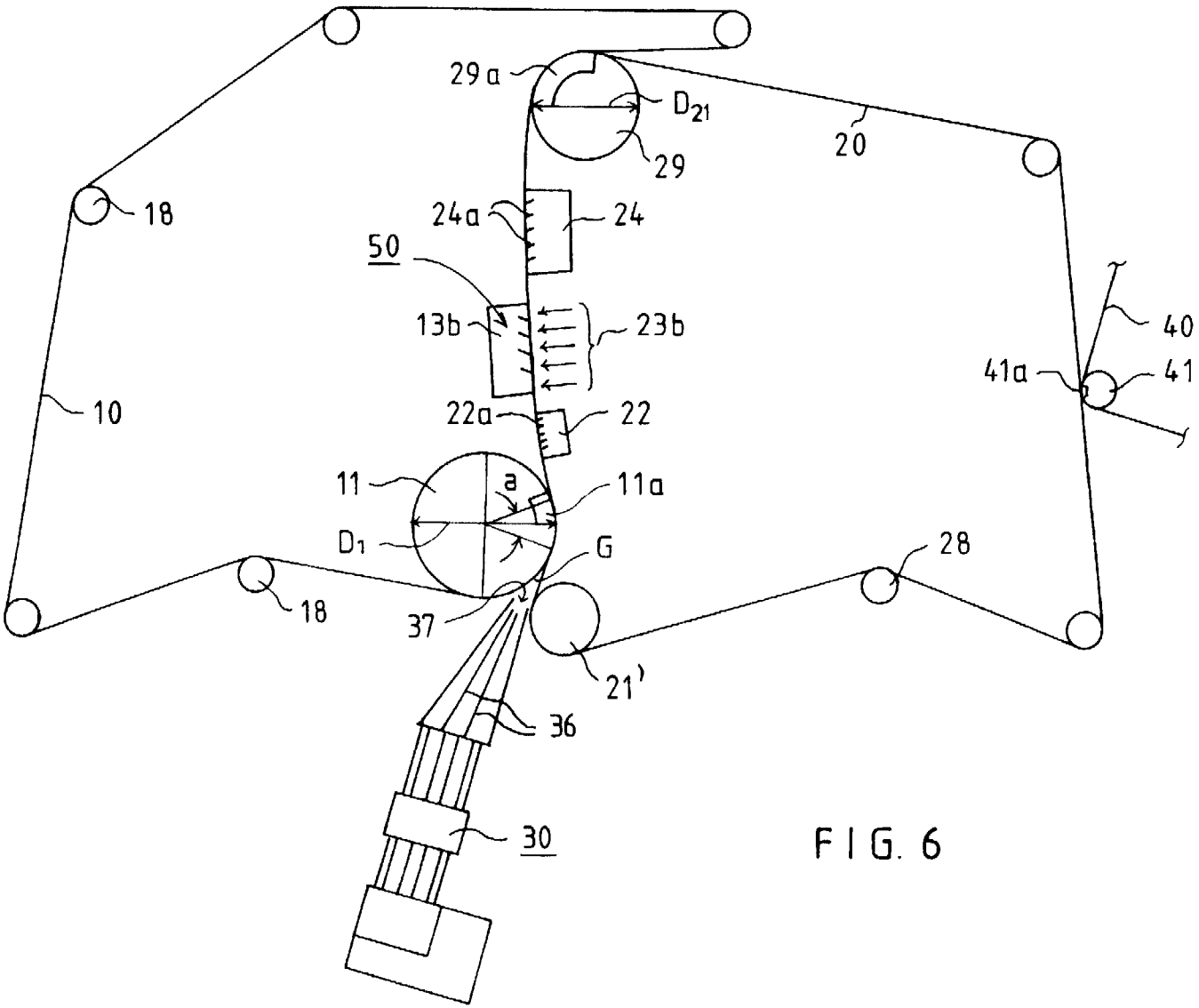
FIG. 6 is a schematic view of the vertical former shown in FIG. 5 in which the support and loading members in the MB-unit following after the first forming roll are arranged in inverted positions compared to the embodiment shown in FIG. 5.

In the embodiments shown in FIGS. 5 and 6, the first forming roll 11 is arranged inside the loop of the covering wire 10, and the second upper forming roll 29 is arranged inside the loop of the carrying wire 20. A suction zone 29*a* of a second forming roll 29 arranged in the loop of the carrying wire 20 guarantees that, after the suction zone 29*a*, the web W follows the carrying wire 20 which is guided by guide rolls 28 and on which the web W is passed onto a pick-up roll 41. On a suction zone 41*a* of pick-up roll 41, the web W is transferred onto a pick-up fabric 40 which carries the web W into the press section (not shown).

In all of the embodiments shown in FIGS. 1–8, the wire guide roll arranged opposite to the first forming roll 11,21 in the area of the forming gap G is denoted by the reference 21',11'.

As shown in FIGS. 5–8, the first forming roll 11,21 is followed by a first forming shoe 22 which has a blade deck 22*a* with a curve radius $R_1$. The first forming shoe 22 is followed by the MB-unit 50 and after the MB-unit, there is a second forming shoe 24 provided with a curved blade deck 24*a*. After the second forming shoe 24, there is the second forming roll 29. FIGS. 5 and 6 differ from one another in the respect only that in FIG. 5 the loading element 13*a* of the MB-unit 50 is arranged inside the loop of the covering wire and the support element 23*a* is arranged inside the loop of the carrying wire 20, whereas in FIG. 6 the corresponding elements 13*b*, 23*b* are arranged inside the opposite wire loops 20.

Figure 7:
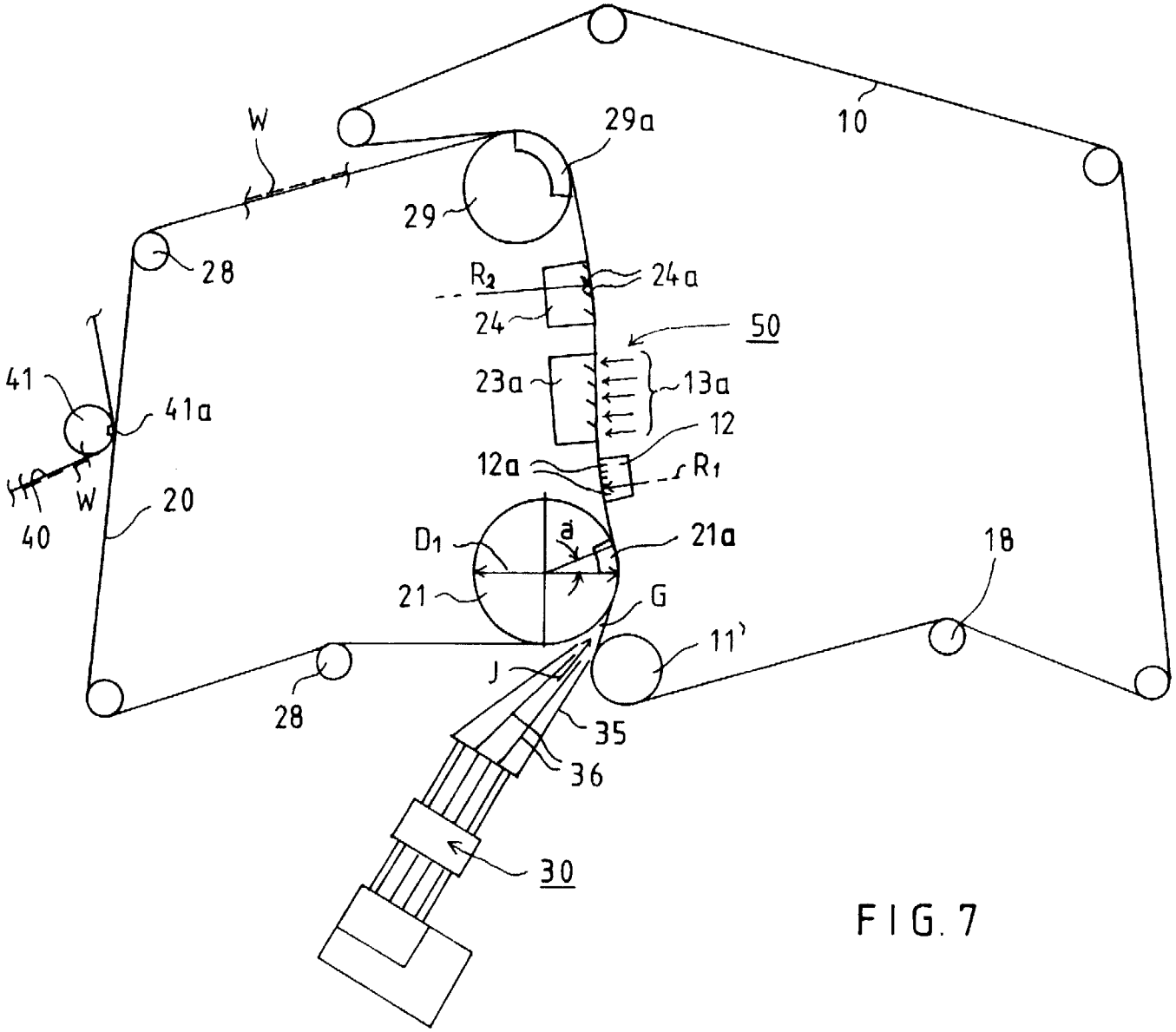
FIG. 7 is a schematic view of an embodiment in accordance with the invention in which, unlike the embodiments shown in FIGS. 5 and 6, the first forming roll in the gap area and the second upper roll terminating the twin-wire zone are arranged inside the loop of the carrying wire.
Figure 8:
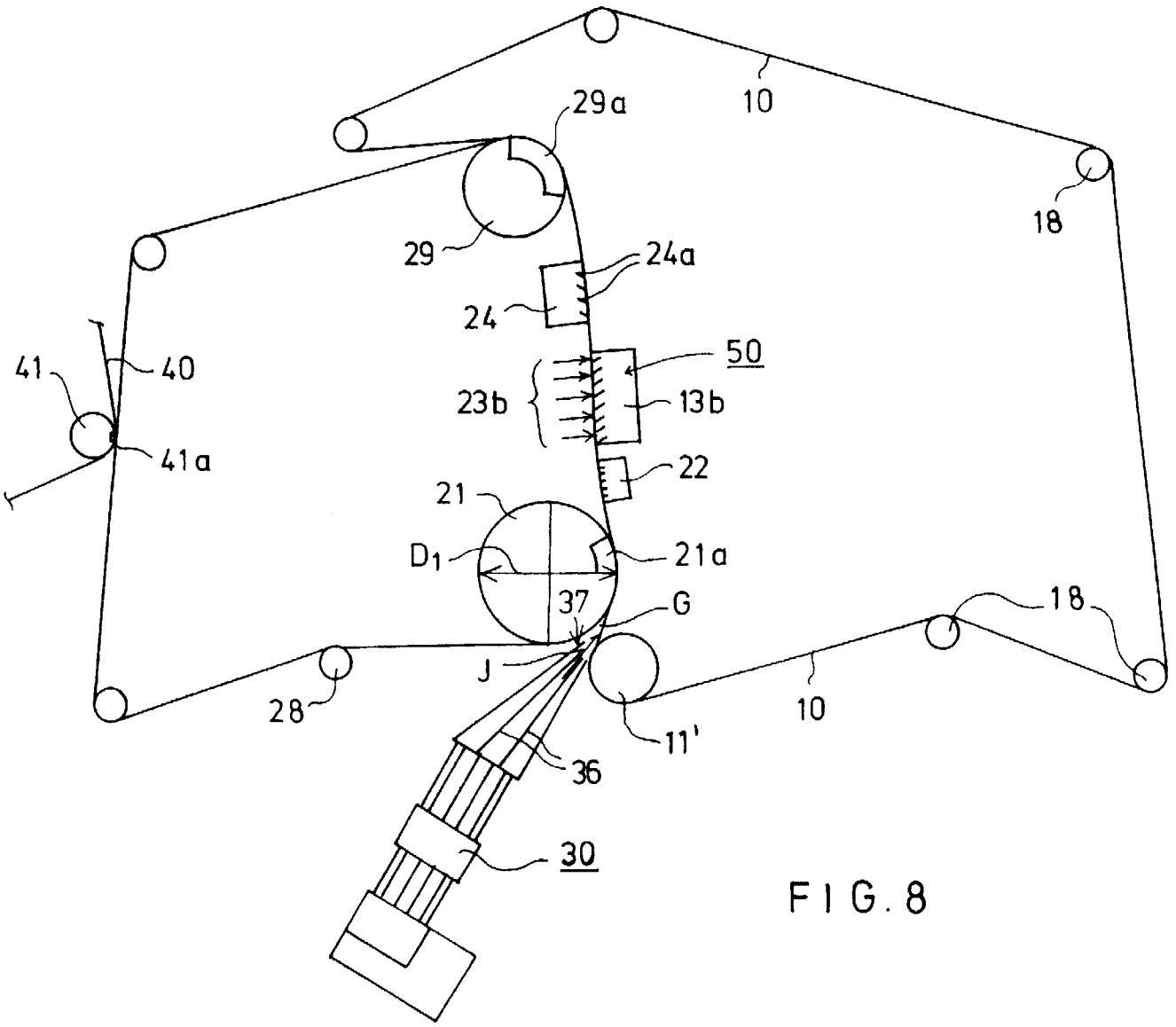
FIG. 8 is a schematic view of a former in accordance with the invention in which the support and loading blades in the MB-unit following after the first forming roll are arranged in inverted positions compared to the embodiment shown in FIG. 7.

FIGS. 7 and 8 illustrate vertical versions of the former in accordance with the invention which differ from FIGS. 5 and 6 in the respect that both the first forming roll 21 and the second forming roll 29 are arranged inside the loop of the carrying wire 20 one above the other.

The diameter $D_{21}$ of the second forming suction roll 29 shown in FIGS. 5–8 is typically selected in the range from about 1.0 m to about 1.8 m, preferably in the range from about 1.4 m to about 1.6 m.

FIGS. 7 and 8 differ from one another exclusively in respect of the relative positions of the elements 13*a*/13*b* and 23*a*/23*b* in the MB-unit 50, in a similar manner as the embodiment shown in FIG. 5 differ s from the embodiment shown in FIG. 6.

Within the scope of the invention, a number of variations different from the embodiments shown in FIGS. 1–8 are possible provided that the four specific features of the invention mentioned above are applied as a combination. For example, differing from the embodiments illustrated in FIGS. 1–8, in particular for constructing a former to manufacture thinner grades of paper, the paper web W can be passed directly from the wrap sector a of the first forming roll 11,21 to the MB-unit 50 without using a first forming shoe 12,22 provided with a curved blade deck or an equivalent drainage unit 12 provided with a planar blade deck 12*a* situated in between (as shown in FIGS. 2 and 3).

The mutual effects of synergy of the above-mentioned four specific features of the invention will be described in the following in more detail with reference to FIGS. 9A–16.

Figure 9A:
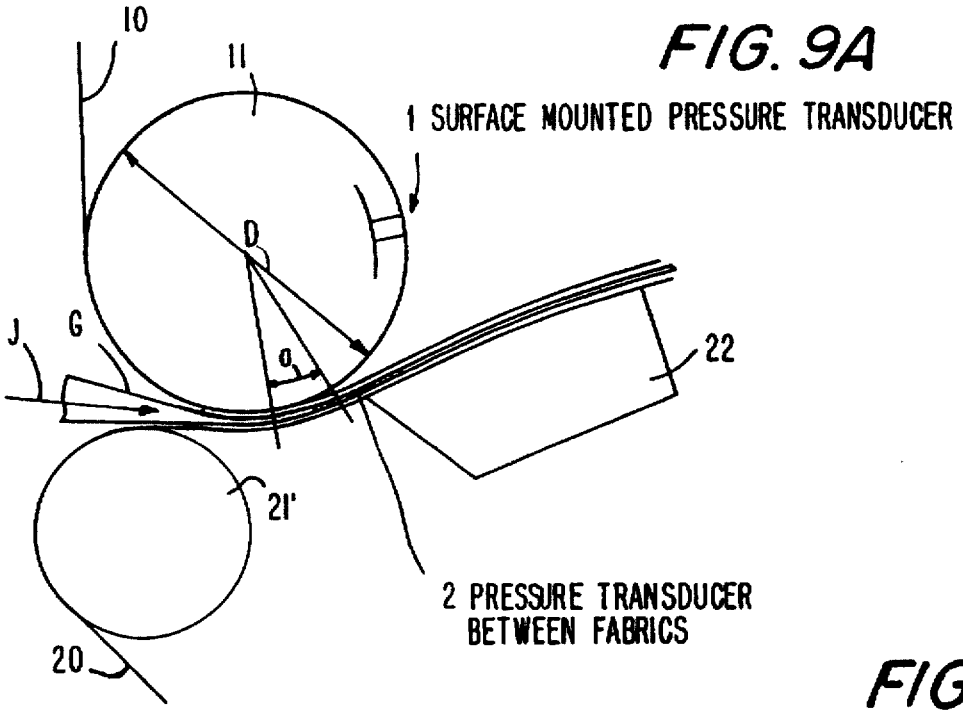
FIG. 9A is a schematic illustration of an arrangement for measuring the pressure profile at the first forming roll.
Figure 9B:
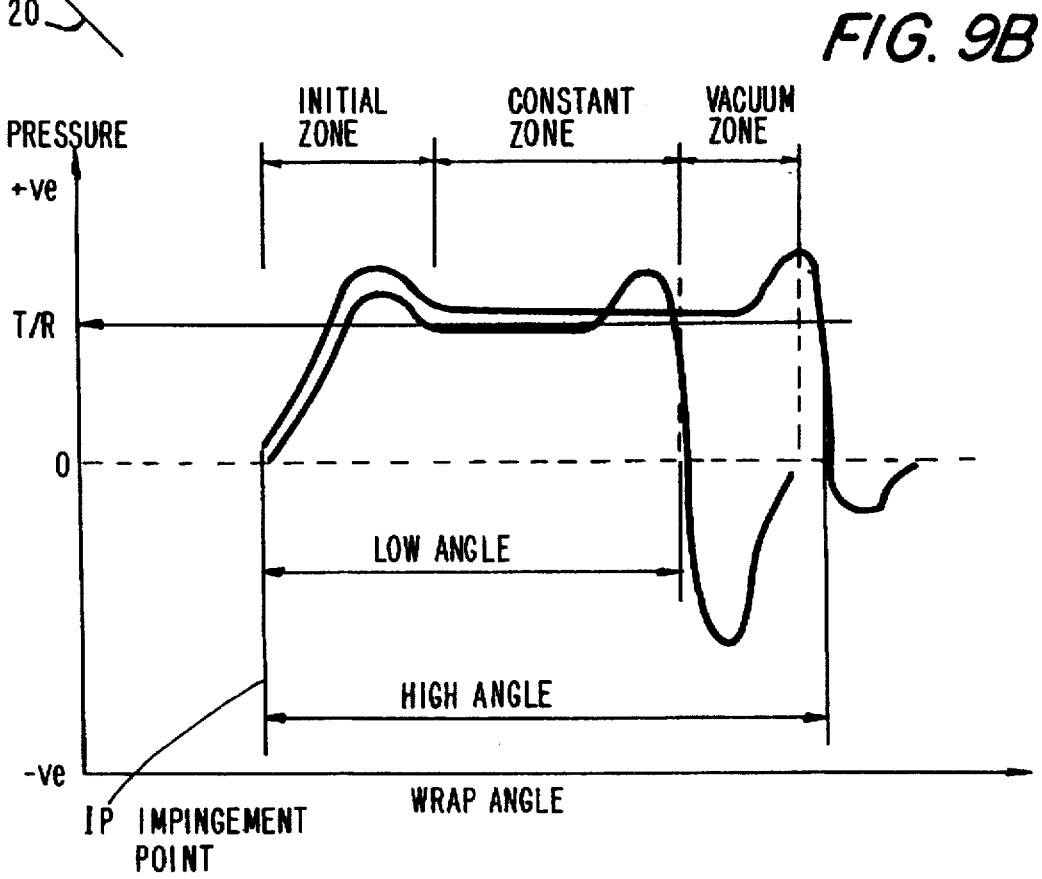
FIG. 9B is a graphic illustration of results of measurement of the pressure profile at the first forming roll utilizing the arrangement shown in FIG. 9A.

FIG. 9A shows the area of the forming gap in a former in accordance with the invention in greater detail and the mounting of a surface mounted pressure transducer 1 and a pressure transducer 2 arranged between the wires. FIG. 9B shows that the drainage pattern through the forming zone on the first forming roll 11 actually has three distinct phases. Initially, a large discharge of water passes through the outer fabric 20 (which may be the covering wire or the carrying wire depending on the construction) in a straight line from the jet's impingement point IP against the fabric 20 (the initial zone). The jet J increases in thickness slightly at this point as a result of its deceleration upon entering a pressure zone created between the fabrics and 20. The initial discharge has only the bare fabric 20 as drainage resistance. This initial discharge must build a fiber mat of substantial resistance which then controls the drainage over the rest of the constant pressure forming zone. Measurements have confirmed that the magnitude of the drainage pressure P in the constant pressure zone is approximated by the formula P=T/R where T is the tension of the outer fabric 20 and R=½D (the radius of roll 11). The tension of the outer fabric 20, which may be a wire as that term is used above, is generally between about 4 kN/m and about 10 kN/m. The nature of the drainage pattern of the roll side cannot be seen although it is likely that it also has some sort of two stage pattern. The surface layers are at a high consistency with the more liquid center core being near headbox consistency.

Pressure profile measurements of the forming roll 11 conducted on a roll and blade former with various forming roll angles have been made. One result from this study is shown in principle in FIG. 9B. These measurements have been made by two different measuring techniques and both clearly show the presence of a vacuum zone 11*a* at the outgoing nip (point C, FIG. 10). Furthermore, the vacuum pulse magnitude increases as the wrap angle a decreases (compare the lines in the vacuum zone in FIG. 9B).

Figure 11A:
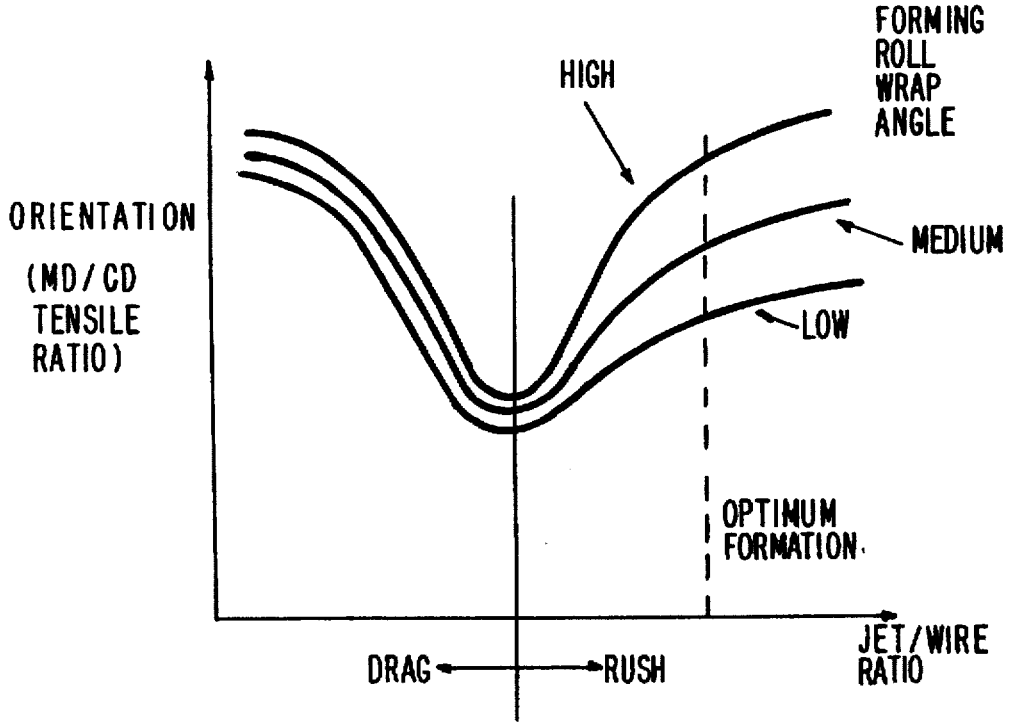
FIG. 11A is a graphic illustration of the control of the fiber orientation in the paper web as a function of jet-to-wire ratio with different wrap angle sectors of the forming wires on the first forming roll.
Figure 11B:
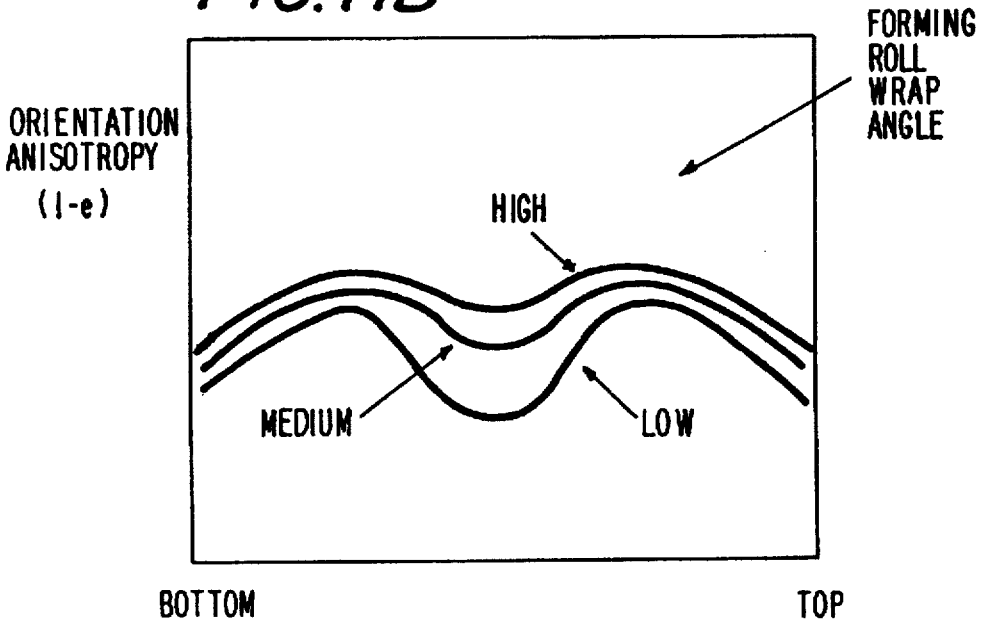
FIG. 11B is a graphic illustration of the orientation anisotropy in the paper web as a function of jet-to-wire ratio with different wrap angle sectors of the forming wires on the first forming roll.

By adjusting the wrap angle a on the forming roll, it is possible to achieve some degree of control on the center layer's anisotropy as shown in FIG. 11B. In practice, it has been found that varying the wrap angle a does not have much influence on the whole sheet's orientation in drag (i.e., when the speed of the suspension jet is less than the speed of the wires). In rush however (when the speed of the suspension jet is greater than the speed of the wires), the effect is quite significant as shown in FIG. 11A. At the jet-to-wire ratio for optimum formation, the sheet's average level or orientation will depend on the wrap angle. With respect to the parameters of the "high", "medium" and "low" wrap angles, it is difficult to provide exact dimensions of the same because these terms are usually defined on the basis of the effect produced which depends on the equipment in which roll provided with such a wrap angle is used. However, solely as a rough estimation of these terms, e.g., in one particular type of former having a wrap angle, a "high" wrap angle is between 45°–60°, a "medium" wrap angle is between 25°–45° and a "low" wrap angle is between 0°–25°, preferably 5°–25°.

Figure 12:
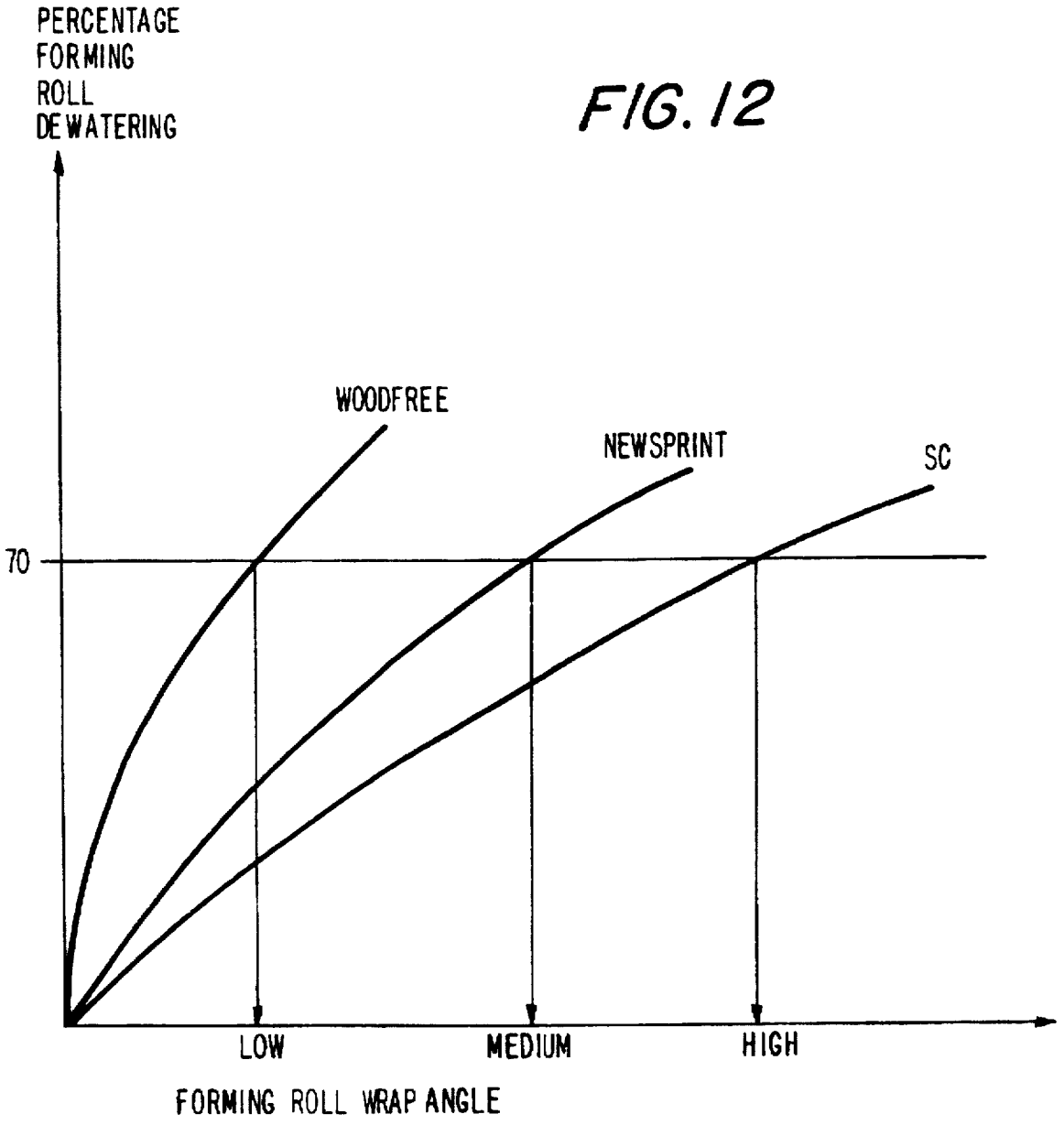
FIG. 12 illustrates the effects of the dimensioning of the wrap angle sector in "ROLL and BLADE" web forming in connection with FIGS. 11A and 11B.

The wrap angle a cannot be selected only with regard to orientation level however. The dimensioning criteria to attain good control of the balance of formation and retention is to set the forming roll 11,21 wrap angle a to drain approximately 70% of the headbox flow rate. As can be seen in FIG. 12, this leads to the situation where the wood containing grades of newsprint and SC grades will be dimensioned with higher wrap angles than wood free grades. It is possible to exploit this fortuitous synergy since wood-containing grades are ideally made with higher orientation levels and therefore should have a higher wrap angle. Conversely, wood free grades normally require a lower level of orientation and should have a lower wrap angle.

With regard to paper structure considerations there are two types of headbox that can be used in connection with a roll and blade former. The standard type has a tube bundle turbulence generator or system and an open converging nozzle section. The high turbulence type headbox 30 uses the same tube bundle system 34 but has in addition turbulence vanes 36 attached at the outlets of the turbulence tubes in the tube bundle system 34 that extend into the nozzle or slice opening 37 area. The use of turbulence vanes 36 for increasing the turbulence is per se well known in the art. The length of the turbulence vanes 36 is but one parameter which enables the turbulence produced by the headbox to be adjusted.

The original purpose of using turbulence vanes 36 in headboxes was to control turbulence and thus formation in Fourdriniers and blade type gap formers. However, in connection with a roll and blade former including other improvements, the use of turbulence vanes 36 takes on another role never envisioned when originally developed. Particularly, it is possible on a roll and blade former to influence the Z-direction orientation (anisotropy) depending on the headbox 30 jet's turbulence level. In practice, this means that high turbulence headboxes 30 need only be used in connection with roll and blade formers when a low level of orientation is needed—such as with copy papers. Most wood-containing grades are made with a high level of orientation and in this case, the standard headbox has better performance, particularly regarding cleanliness and maintenance.

The jet-to-wire ratio is the most influential, adjustment to control the layered orientation structure. FIGS. 10A and 10B show results from a roll and blade former for various jet-to-wire ratios. In this example, the minimum anisotropy occurred at a jet-to-wire ratio of 1.02, whereas this would be at 1.00 with a hybrid former of Fourdrinier. This 2% excess jet velocity is necessary so that after the jet J is decelerated entering the pressure zone between the wires 10 and 20, the jet speed will equal the wire speed. The notation of the X-axis is the distance in the z-direction of the web from the bottom side to the top side measured in grammage, i.e., it is the true distance in thickness in the case that the web density is uniform through the web thickness. The notation of the Y-axis, i.e., the value of the anisotropy, is the amount of additional percentage of fibers in the main direction of orientation of the fibers than the amount of fibers in a perpendicular direction thereto. For example, when the anisotropy has a value of 0.3, there are 30% more fibers oriented in the main direction of fibers than in the perpendicular direction. Note that these axis notations also apply to the lowermost illustration in FIG. 10 as well as to FIGS. 11B, 13B, 14 (lowermost illustration), 15A, 15B and 16B.

As shown in FIGS. 10A and 10B, the average anisotropy increases in magnitude as the jet-to-wire ratio is either decreased (drag) or increased (rush) from jet-to-wire ratio 1.02. The Z-direction anisotropy profile shape in drag is most often a simple curve having minimum anisotropy at the surfaces and maximum anisotropy at the sheet's center. In rush however, the layered anisotropy profile has a local minimum anisotropy at the center as well as at the edges; the maximum anisotropy occurs at the top middle and bottom middle sections.

Figure 10:
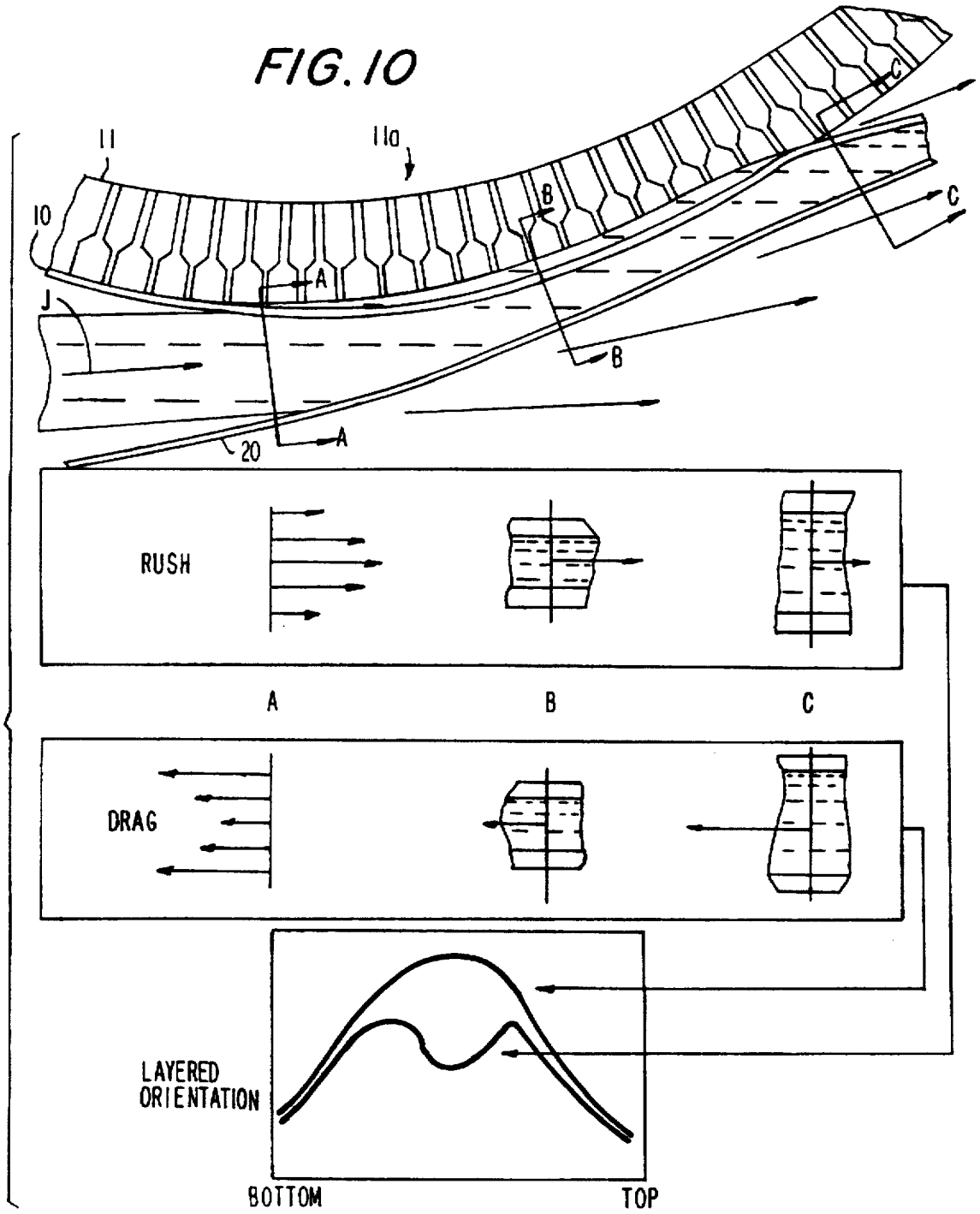
FIG. 10 is a graphic illustration of the jet/wire speed difference profiles and their effects on the layered orientation profile of the paper web.
Figure 10A:
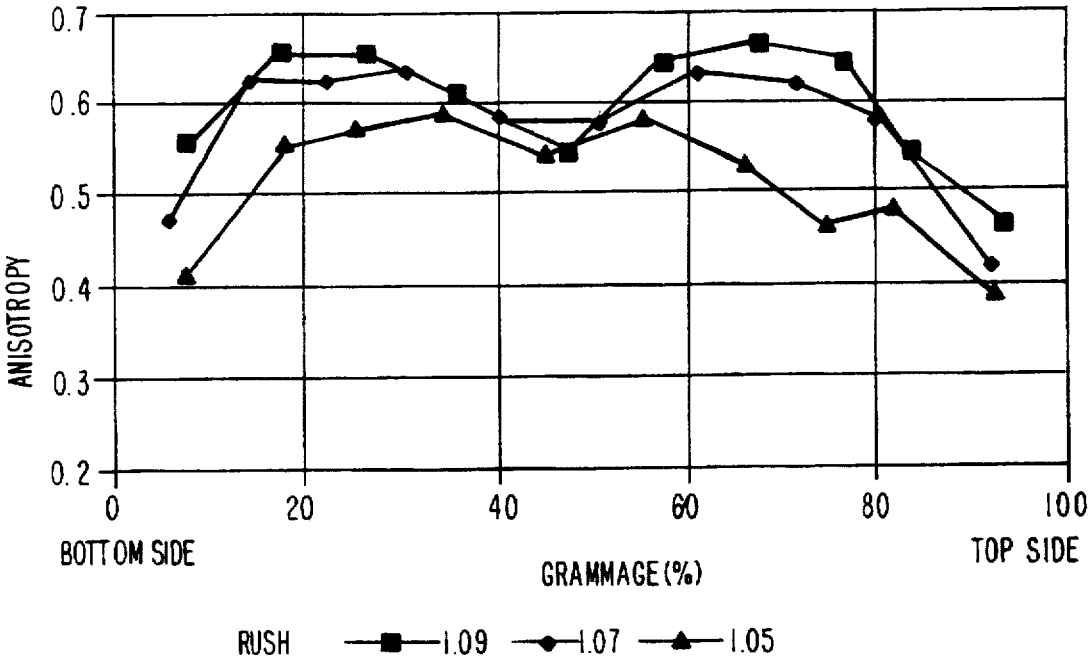
FIG. 10A is a graphic illustration of z-directional distribution of anisotropy from a roll and blade former with various jet-to-wire ratios for a rush situation.
Figure 10B:
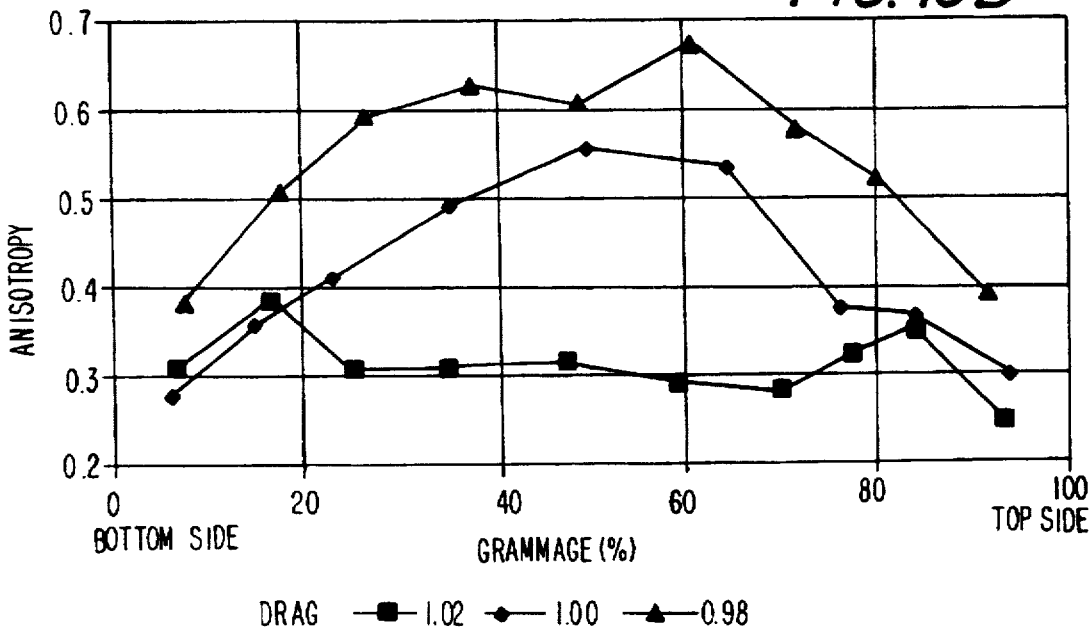
FIG. 10B is a graphic illustration of z-directional distribution of anisotropy from a roll and blade former with various jet-to-wire ratios for a drag situation.

One source of this different shape between rush and drag conditions is shown schematically in FIG. 10. The Z-direction jet-to-wire speed differences are shown throughout the forming zone in both rush and drag situations. Point C in FIG. 10 is the point where the two fabrics 10,20 leave the forming roll 11. It is thought that the two fabrics 10,20 do not leave in a parallel line but rather the fabric 10 on the roll 11 side adheres to the roll 11 before releasing due to the presence of a vacuum zone 11*a* in the outgoing nip. This would cause a velocity change in the liquid center core at point C—as shown in FIG. 10. In rush, the liquid core's velocity is reduced so that drainage at this point and over the forming shoe 22 is at a lower jet-to-wire ratio (less rush) than occurred over the forming roll. Thus the center of the sheet shows a minimum in anisotropy in the center region. Similarly in drag, the liquid core's expansion at point C will further decrease the center layer's jet-to-wire ratio (higher drag) so that the center layer has a region of higher anisotropy.

Another source for the different shape between rush and drag conditions is the deceleration of the suspension jet as it enters the pressure zone in the forming gap occurs progressively through the forming zone, simultaneously with the formation of the web on the wires. In other words, in the rush case, the center layer of the web is formed at a lower effective jet-to-wire ratio than the surface layers of the web and a local minimum in orientation is created near the center of the web (in the Z-direction). Conversely, in drag, the center layer's effective shear is increased by the suspension jet's deceleration and a local maximum is created. As such, in the rush situation at point A, the edges of the web in the z-direction have a lower velocity in view of the resistance of the wires 10,20. At point B, after the edge regions of the web have formed to some extent, the velocity of the web greater than the speed of the wires at the center layer of the web is maintained somewhat. At point C, when the wrap angle sector ends and the force exerted on the web decreases, the velocity of the center layer of the web is decreased. In drag, at point A, the edges of the web in the z-direction have an even lower velocity than the edges of the web with respect to the velocity of the wires 10,20 in view of the resistance of the wires 10,20. At point B, after the edge regions of the web have formed to some extent, the lower velocity of the web with respect to the wires at the center layer of the web is maintained somewhat. At point C, when the wrap angle sector ends and the force exerted on the web decreases, the velocity of the center layer of the web is decreased with respect to the speed of the wires 10,20 even further.

Both sources mentioned above are similar in that there is a velocity reduction in the liquid center core. Experimentally, it has been found that the magnitude of the center layer's orientation change is dependent on both wrap angle and the tension of the wires. In rush, the center layer's local minimum is deeper with lower wrap angles and with lower wire tension. If the jet deceleration source were the only mechanism occurring, the center layer's local minimum would be expected to become deeper with a higher wrap angle and especially with a higher wire tension.

FIG. 13B shows that in both rush and drag conditions the sheet's surfaces have a rather low level of anisotropy even at high shear (extreme rush or drag). If shear were the only consideration, the surface layers should be quite highly orientated. In practice, both drainage rate and initial turbulence in the headbox jet affect the level or orientation in the sheet's surface layers.

It is possible to manipulate the headbox jet's turbulence level and thereby influence the Z-direction anisotropy profile. In a headbox without vanes, the turbulence level depends on the flow rate and is not independently adjustable. However, with the headbox 30 filled with vanes 36 utilized in accordance with the present invention, the length of the vanes 36 can be varied, or some other criteria of the headbox adjusted to provide different amounts of turbulence. The effects of this on orientation, measured through the machine direction/cross-machine direction tensile ratio, are shown in FIG. 13A where medium turbulence means, e.g., shorter vanes 36, and high turbulence means, e.g., longer vanes, 36, i.e., there is a direct relationship between the length of the vanes and the amount of turbulence generated thereby. The initial turbulence level influences the anisotropy level over about 20% of the sheet thickness from the surfaces (40% in total)—see FIG. 13B. The turbulence is probably dissipated before the center of the sheet is drained.

Even though the effects are mainly near the surface, the influence of the headbox jet's turbulence level on the whole sheet's orientation level is quite dramatic as shown in FIG. 13A. The MD/CD tensile ratio can in practice be manipulated from nearly "square" at 1.5:1 to highly orientated at over 4:1. This is a wider range than is normally used in paper making practice. Only grades needing a low level of orientation need a headbox 30 equipped with vanes 36 on a roll and blade formers. More highly orientated grades are better off with the standard headbox since there is less dirtying potential and no vane maintenance or vane damage risk.

It should also be noted that using headbox jet turbulence level to control orientation level, only works on gap formers equipped with a forming roll 11,21 as the first drainage element. The drainage rate has to be quite rapid to trap the turbulence near the surface layers before the turbulence dissipates. On blade type gap formers the effects of altering the headbox jet's turbulence level will be very minor due to their slower drainage rate.

Figure 14:
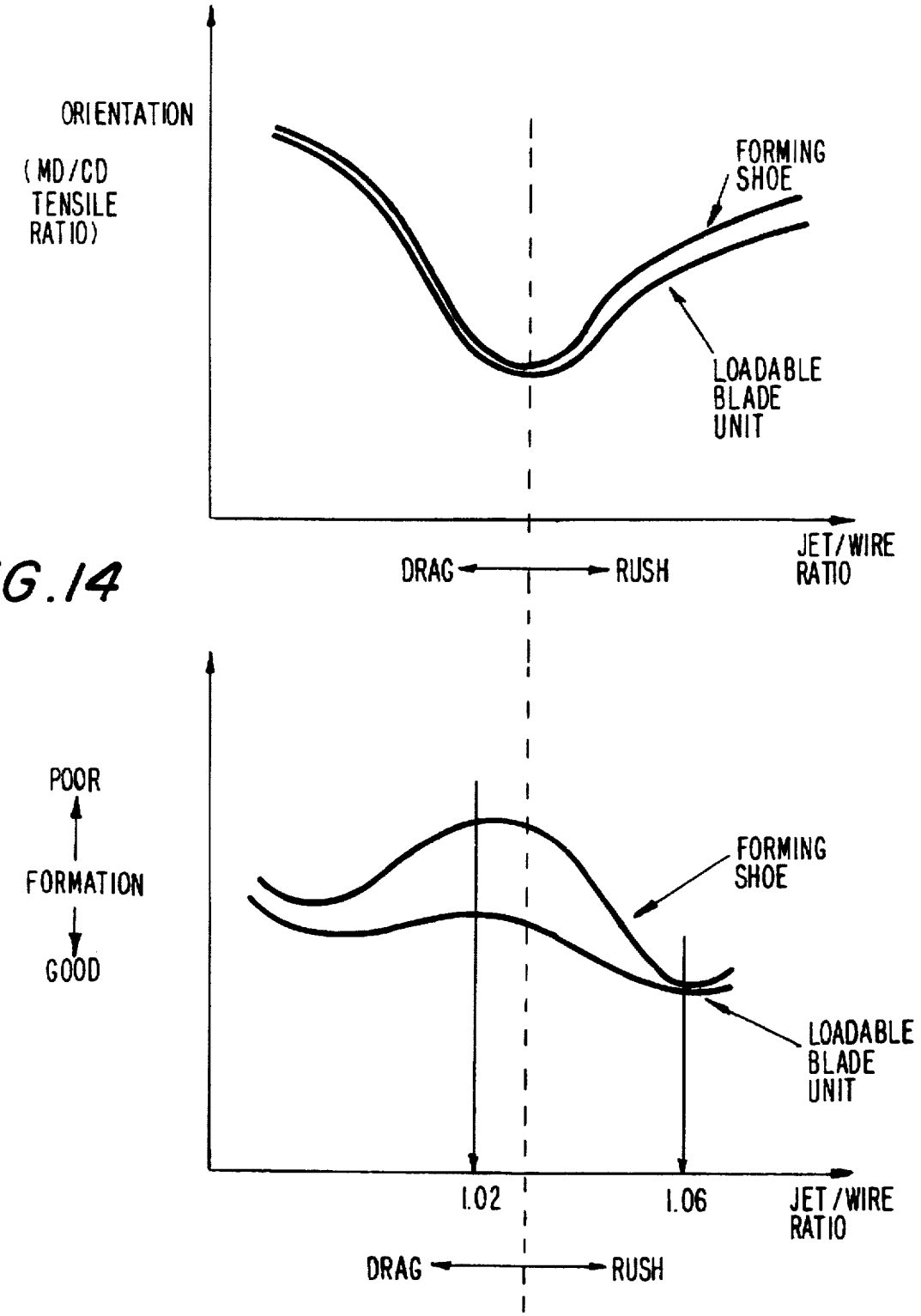
FIG. 14 illustrates the control of web formation and fiber orientation on "ROLL and BLADE" formers.

The main influence on orientation magnitude and formation is the jet-to-wire ratio. In this invention, it has been recognized that dimensioning the wrap angle a and modifying the headbox 30 turbulence can be used to alter the orientation dependence on jet-to-wire ratio. This is a key point of the present invention. FIG. 14 shows a comparison of the orientation and formation dependence on jet-to-wire ratio for a roll and blade former using a standard blade shoe 22 and a loadable MB-blade unit 50. With the standard blade shoe 22, there are two optimum areas for formation, both of which give a highly orientated sheet. The optimum jet-to-wire ratio in rush is typically in the range 1.06 to 1.08 or, in drag, 0.96 to 0.98. The exact formation optimum differs for different pulps and running conditions and must be found experimentally for each case. With low headbox nozzle contraction used in commercial practice, a blade shoe 22 will give its worst formation at the point of minimum orientation. Using a loadable MB-blade unit 50 gives a characteristic where formation is much less dependent on jet-to-wire ratio than the blade shoe 22 case.

This is quite logical considering that the loadable MB-blade unit 50 can have the pulsation magnitude better optimized that the blade shoe 22 and thus it is less dependent on shear to create good formation.

In practice, it has been found that the differences in formation at high orientation (e.g. at jet-to-wire ratio 1.06 as in FIG. 14) between a loadable MB-blade unit 50 and a standard blade shoe 22 are fairly small. However, the improvements in formation the loadable MB-blade unit 50 has over the standard blade shoe 22 at low orientation are considerable (e.g., at jet-to-wire ratio 1.02 as in FIG. 14). The differences in Z-directional formation distribution between these two cases are shown in FIGS. 15A and 15B.

Figure 16A:
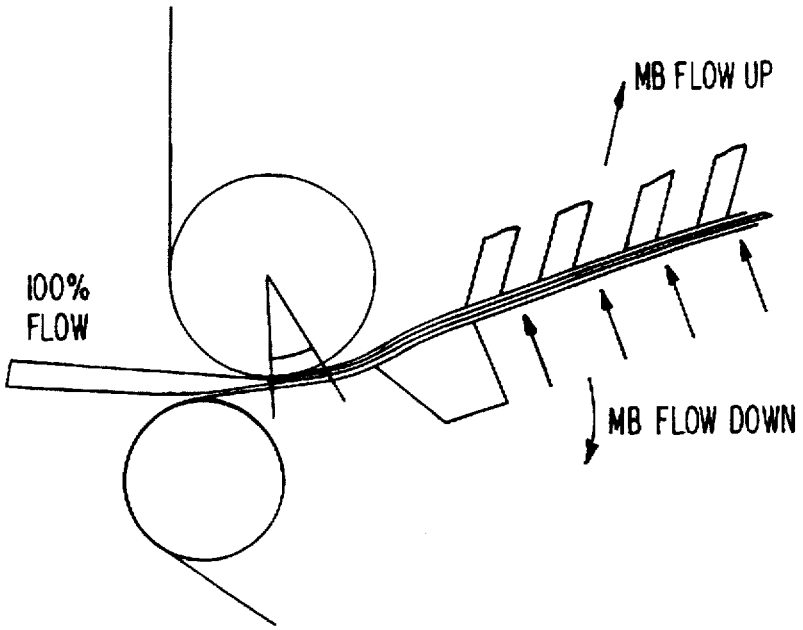
FIG. 16A is a schematic illustration of the area of the forming gap of the former in accordance with the invention.
Figure 16B:
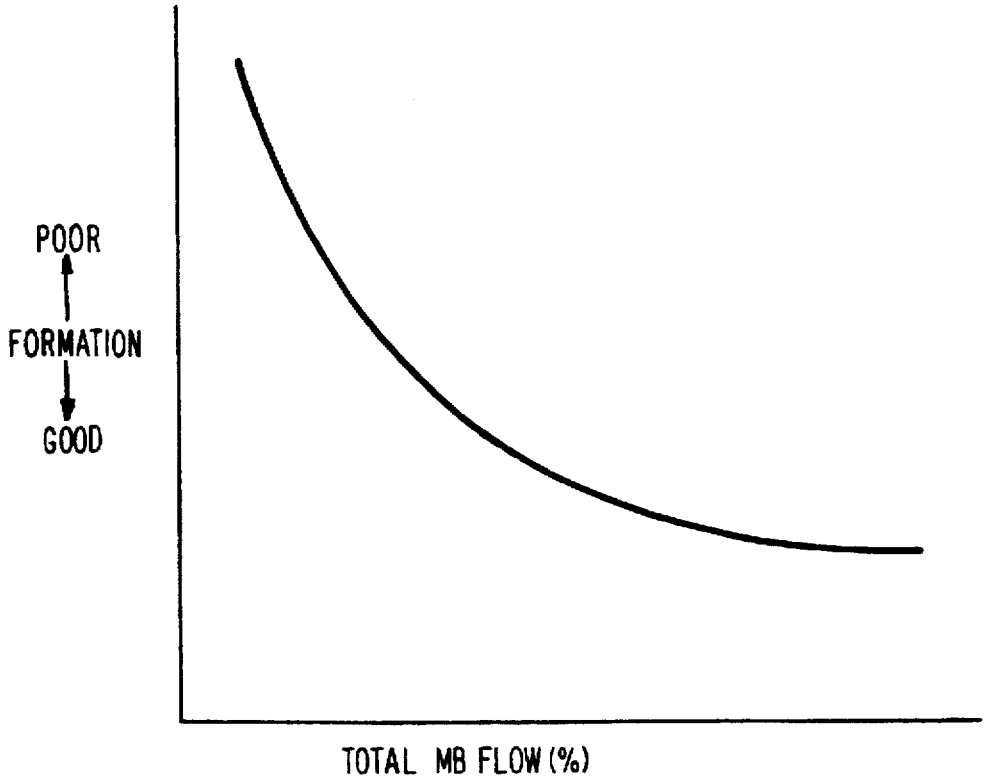
FIG. 16B is a graphic illustration of formation as a function of the relative amount of water flow removed by the MB-unit or equivalent in the former shown in FIG. 16A.

The Z-directional formation distribution has been measured by the layer splitting and image analyzing technique. At high orientation, there is no significant difference in the Z-directional formation distribution between these two blade units, but at low orientation, the loadable MB-blade unit 50 gives much improved results especially in the sheet's center layers. Tuning experience has also shown that at high orientation the formation results of a loadable MB-blade unit 50 is not very sensitive to loading adjustment, but when operating at low orientation the loadable MB-blade unit 50 must be fine tuned to give the best result. One factor in this fine tuning is the water flow removed by the loadable MB-blade unit 50—as shown in FIG. 16B. If there is insufficient water flow, the loadable MB-blade unit 50 can not be properly tuned. Again, this means a wrap angle a below about 25° (FIG. 16A).

The examples provided above are not meant to be exclusive. Many other variations of the present invention would be obvious to those skilled in the art, and are contemplated to be within the scope of the appended claims. For example, any of the parameters mentioned above which have an effect on the anisotropy of the web may be controlled, regulated and/or set relative to the jet-to-wire ratio independent of the control, regulation or setting of other parameters of the forming section which affect the web formation or web anisotropy. Multiple parameters as set forth above can also be set independently relative to the jet-to-wire ratio. Alternatively, two or more of these web-anisotropy or web-formation parameters may be set relative to one another and possibly also relative to the jet-to-wire ratio.

We claim:

1. A method for forming a web in a roll and blade gap former having a desired anisotropy, comprising the steps of generating turbulence in a stock suspension jet in a slice channel of a headbox, discharging the stock suspension jet at a first speed from a slice opening of the slice channel of the headbox, directing the stock suspension jet into a forming gap defined in part by a first forming roll having a diameter greater than or equal to about 1.4 m, the stock suspension jet being directed into a convergence of first and second wires which define a twin-wire zone after said forming gap, said first forming roll being arranged in a loop of one of said first and second wires, directing a run of said twin-wire zone after said forming gap in a curve over a wrap angle sector of said first forming roll having a magnitude less than about 25°, producing a pulsating pressure effect on the web after said curved run of said twin-wire zone over said wrap angle of said first forming roll, guiding said first and second wires to run at a second speed, controlling said first speed of the stock suspension jet relative to said second speed of said first and second wires to thereby define a jet-to-wire ratio which constitutes the ratio of said second speed to said first speed, determining the diameter of said first forming roll, said wrap angle sector of said first forming roll, a magnitude of the pulsating pressure effect and an amount of turbulence in the stock suspension jet at which the desired anisotropy in the web will be attained by adjusting the diameter of said first forming roll, said wrap angle sector of the twin-wire zone about said first forming roll, the magnitude of the pulsating pressure effect and the amount of turbulence in the stock suspension jet relative to said jet-to-wire ratio and to each other until the web attains the desired anisotropy at a specific diameter of said first forming roll, a specific wrap angle sector of the twin-wire about said first forming roll, a specific magnitude of the pulsating pressure effect and a specific amount of turbulence in the stock suspension jet, and operating the former with said first forming roll having said specific diameter, the twin-wire zone having said specific wrap angle sector about said first forming roll, the pulsating pressure effect having said specific magnitude and the stock suspension jet having the specific amount of turbulence.

2. The method of claim 1, wherein the step of producing said pressure pulsating effect comprises the steps of:

arranging a first forming member having stationary forming blades in a loop of said first wire, arranging a second forming member having loadable forming blades in a loop of said second wire such that said blades in said second forming member alternate with said blades in said first forming member in a running direction of the web, and regulating a pressure impulse applied to said blades in said second forming member to vary the loading of said blades in said second forming member in order to provide an adjustable drainage and formation effect.

3. The method of claim 2, further comprising the step of:

applying a vacuum through gap spaces defined between said blades in at least one of said first and second forming members to intensify the drainage of water through said gap spaces.

4. The method of claim 1, wherein said wrap angle sector of said first forming roll is adjusted in a range from about 5° to about 25°.

5. The method of claim 1, wherein the diameter of said first forming roll is adjusted in a range from about 1.4 m to about 1.8.

6. The method of claim 1, wherein said first forming roll comprises a roll mantle having through perforations leading from an exterior of said roll mantle to an interior of said roll mantle and means defining a suction chamber in said interior in said wrap angle sector such that said through perforations are communicable with said suction chamber.

7. The method of claim 1, further comprising the steps of:

arranging a first forming shoe in said twin-wire zone after said first forming roll, said first forming shoe comprising a linear and/or curved blade deck, and arranging an MB-unit in said twin-wire zone after said first forming shoe, said MB-unit comprising at least one support member arranged inside a loop of said first wire and at least one drainage and loading member arranged in opposed relationship to said at least one support member in a loop of said second wire, said at least one support member and said at least one drainage and loading member comprising blades and defining a twin-wire blade zone therebetween.

8. The method of claim 7, further comprising the steps of:

arranging a second forming shoe in said twin-wire zone after said MB-unit, and arranging a second forming roll in said twin-wire zone after said second forming shoe, said first wire being separated from the web after or in conjunction with said second forming roll whereby the web follows said first wire.

9. The method of claim 8, wherein after said wrap angle sector, the run of said twin-wire zone is substantially horizontal, the run of said twin-wire zone being curved over a sector of said second forming roll, said sector of said second forming roll being from about 10° to about 40°, the run of said twin-wire zone being downwardly inclined after said second forming roll, further comprising the step of:

arranging at least one suction box in a loop of said first wire in connection with the downwardly inclined run of said twin-wire zone after said second forming roll, said second wire being separated from the web after said at least one suction box.

10. The method of claim 2, further comprising the step of:

adjusting the position of said blades in said first forming member relative to said first wire.

11. The method of claim 1, wherein the run of said twin-wire zone is substantially vertical and said first and second wires travel in an upward direction in said twin-wire zone, further comprising the step of:

arranging a second forming roll comprising a suction zone at an end of said twin-wire zone, said second wire being separated from the web proximate in an end of said suction zone in a running direction of the web such that the web is carried only on said first wire thereafter.

12. A method for forming a web in a roll and blade gap former having a desired anisotropy, comprising the steps of:

generating turbulence in a stock suspension jet in a slice channel of a headbox, discharging the stock suspension jet from a slice opening of the slice channel of the headbox, directing the stock suspension jet into a forming gap defined in part by a first forming roll having a diameter greater than or equal to about 1.4 m, the stock suspension jet being directed into a convergence of first and second wires which define a twin-wire zone after said forming gap, said first forming roll being arranged in a loop of one of said first and second wires, directing a run of said twin-wire zone after said forming gap in a curve over a wrap angle sector of said first forming roll having a magnitude less than about 25°, producing a pulsating pressure effect on the web after said curved run of said twin-wire zone over said wrap angle of said first forming roll, determining the diameter of said first forming roll, said wrap angle sector of said first forming roll, a magnitude of the pulsating pressure effect and an amount of turbulence in the stock suspension jet at which the desired anisotropy in the web will be attained by adjusting the diameter of said first forming roll, said wrap angle sector of the twin-wire zone about said first forming roll, the magnitude of the pulsating pressure effect and the amount of turbulence in the stock suspension jet relative to each other until the web attains the desired anisotropy at a specific diameter of said first forming roll, a specific wrap angle sector of the twin-wire zone about said first forming roll, a specific magnitude of the pulsating pressure effect and a specific amount of turbulence in the stock suspension jet, and operating the former with said first forming roll having said specific diameter, the twin-wire zone having said specific wrap angle sector about said first forming roll, the pulsating pressure effect having said specific magnitude and the stock suspension jet having the specific amount of turbulence.

13. The method of claim 12, wherein said wrap angle sector of said first forming roll is adjusted in a range from about 5° to about 25°.

14. The method of claim 12, wherein the diameter of said first forming roll is adjusted in a range from about 1.4 m to about 1.8.

15. The method of claim 12, wherein said first forming roll comprises a roll mantle having through perforations leading from an exterior of said roll mantle to an interior of said roll mantle and means defining a suction chamber in said interior in said wrap angle sector such that said through perforations are communicable with said suction chamber.

16. The method of claim 12, further comprising the steps of:

arranging a first forming shoe in said twin-wire zone after said first forming roll, said first forming shoe comprising a linear and/or curved blade deck, and arranging an MB-unit in said twin-wire zone after said first forming shoe, said MB-unit comprising at least one support member arranged inside a loop of said first wire and at least one drainage and loading member arranged in opposed relationship to said at least one support member in a loop of said second wire, said at least one support member and said at least one drainage and loading member comprising blades and defining a twin-wire blade zone therebetween.

17. The method of claim 16, further comprising the steps of:

arranging a second forming shoe in said twin-wire zone after said MB-unit, and arranging a second forming roll in said twin-wire zone after said second forming shoe, said first wire being separated from the web after or in conjunction with said second forming roll whereby the web follows said first wire.

18. The method of claim 17, wherein after said wrap angle sector, the run of said twin-wire zone is substantially horizontal, the run of said twin-wire zone being curved over a sector of said second forming roll, said sector of said second forming roll being from about 10° to about 40°, the run of said twin-wire zone being downwardly inclined after said second forming roll, further comprising the step of:

arranging at least one suction box in a loop of said first wire in connection with the downwardly inclined run of said twin-wire zone after said second forming roll, said second wire being separated from the web after said at least one suction box.

19. The method of claim 12, wherein the run of said twin-wire zone is substantially vertical and said first and second wires travel in an upward direction in said twin-wire zone, further comprising the step of:

arranging a second forming roll comprising a suction zone at an end of said twin-wire zone, said second wire being separated from the web proximate in an end of said suction zone in a running direction of the web such that the web is carried only on said first wire thereafter.

20. A method for forming a web in a roll and blade gap former having a desired anisotropy, comprising the steps of:

forming a stock suspension jet in a slice channel of a headbox, discharging the stock suspension jet at a first speed from a slice opening of the slice channel of the headbox, directing the stock suspension jet into a forming gap defined in part by a first forming roll, the stock suspension jet being directed into a convergence of first and second wires which define a twin-wire zone after said forming gap, said first forming roll being arranged in a loop of one of said first and second wires, directing a run of said twin-wire zone after said forming gap in a curve over a wrap angle sector of said first forming roll, producing a pulsating pressure effect on the web after said curved run of said twin-wire zone over said wrap angle of said first forming roll, guiding said first and second wires to run at a second speed, controlling said first speed of the stock suspension jet relative to said second speed of said first and second wires to thereby define a jet-to-wire ratio which constitutes the ratio of said second speed to said first speed, determining the diameter of said first forming roll, said wrap angle sector of said first forming roll, a magnitude of the pulsating pressure effect and an amount of turbulence in the stock suspension jet at which the desired anisotropy in the web will be attained by selecting the diameter of said first forming roll greater than or equal to about 1.4 m, said wrap angle sector of the twin-wire zone about said first forming roll less than about 25°, the magnitude of the pulsating pressure effect and the amount of turbulence in the stock suspension jet in relation to each other until the web attains the desired anisotropy at a specific diameter of said first forming roll, a specific wrap angle sector of the twin-wire zone about said first forming roll, a specific magnitude of the pulsating pressure effect and a specific amount of turbulence in the stock suspension jet, generating the specific amount of turbulence in the stock suspension jet in the slice channel of a headbox, providing the first forming roll with the specific diameter greater than or equal to about 1.4 m, directing the run of said twin-wire zone after said forming gap over the specific wrap angle sector of said first forming roll having a magnitude less than about 25°, and generating the pulsating pressure effect having the specific magnitude.

* * * * *